US007033245B2

(12) United States Patent
Hasegawa et al.

(10) Patent No.: US 7,033,245 B2
(45) Date of Patent: Apr. 25, 2006

(54) LAPPING APPARATUS AND LAPPING METHOD

(75) Inventors: Kiyoshi Hasegawa, Yokohama (JP); Masahiko Iizumi, Fujisawa (JP); Masahiro Omata, Yokohama (JP); Takashi Ogino, Yokohama (JP); Tomohiro Kondo, Mishima (JP); Kazuo Takeda, Odawara (JP); Takafumi Watanabe, Yokohama (JP); Yoshiyuki Chida, Yokohama (JP); Yasushi Matsushita, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/774,528

(22) Filed: Feb. 10, 2004

(65) Prior Publication Data

US 2004/0166767 A1 Aug. 26, 2004

(30) Foreign Application Priority Data

Feb. 12, 2003 (JP) ..... 2003-034050
Feb. 12, 2003 (JP) ..... 2003-034065

(51) Int. Cl.
*B24B 49/02* (2006.01)
*B24B 19/12* (2006.01)
*B24B 21/06* (2006.01)

(52) U.S. Cl. ..... 451/5; 451/303

(58) Field of Classification Search ..... 451/5, 451/134, 140, 143, 168, 303, 307

See application file for complete search history.

(56) References Cited

U.S. PATENT DOCUMENTS

| | | | | | |
|---|---|---|---|---|---|
| 4,833,834 | A | * | 5/1989 | Patterson et al. | 451/310 |
| 4,993,190 | A | * | 2/1991 | Hiyoshi et al. | 451/307 |
| 5,193,314 | A | * | 3/1993 | Wormley et al. | 451/5 |
| 5,251,404 | A | * | 10/1993 | Wasserbaech | 451/303 |
| 5,616,070 | A | * | 4/1997 | Rice et al. | 451/62 |
| 6,354,920 | B1 | * | 3/2002 | Judge et al. | 451/62 |
| 6,383,063 | B1 | * | 5/2002 | Ohashi et al. | 451/303 |

FOREIGN PATENT DOCUMENTS

| | | | | |
|---|---|---|---|---|
| DE | 42 35 408 | A1 | | 4/1994 |
| EP | 0 997 229 | A1 | | 5/2000 |
| FR | 2825652 | A1 | * | 12/2002 |
| JP | 4-2770 | Y2 | | 1/1992 |
| JP | 5-9225 | B2 | | 2/1993 |
| JP | 07-052005 | A | | 2/1995 |
| JP | 7-237116 | A | | 9/1995 |
| JP | 08257889 | A | * | 10/1996 |
| JP | 2000-205377 | A | | 7/2000 |
| JP | 2000-263410 | A | | 9/2000 |

* cited by examiner

*Primary Examiner*—David B. Thomas
(74) *Attorney, Agent, or Firm*—Foley & Lardner LLP

(57) ABSTRACT

A lapping apparatus lapping a work having a pre-machined surface comprises a lapping film which includes a thin substrate having a surface provided with abrasive grains, a shoe disposed at a back surface side of the lapping film, a shoe driving unit which drives the shoe toward the work in order to press the abrasive-grained surface of the lapping film to the pre-machined surface of the work, a rotational driving unit which drives the work rotationally, a detecting unit which detects the position of the rotating work in the rotating direction, and a controlling unit which controls the pressing force of the shoe driving unit so as to drive the shoe correspondingly to the position of the work in the rotating direction during machining.

24 Claims, 22 Drawing Sheets

LAPPING APPARATUS AND LAPPING METHOD

BACKGROUND OF THE INVENTION

1. Field of the Invention

The present invention relates to a lapping apparatus and a lapping method for film-lapping (hereinafter simply called "lapping") a pre-machined surface of a work by a lapping film (hereinafter simply and occasionally called "film") provided with abrasive grains.

2. Description of the Related Art

There has been recently conducted lapping by a lapping film having one surface provided with abrasive grains, in case of finishing a work having a cross-sectionally arcuate outer peripheral surface, such as pin portions and journal portions of a crankshaft or cam-lobe portions and journal portions of a camshaft.

Such lapping is conducted by covering a pre-machined surface of a work by a lapping film, and by machining the work by an abrasive-grained surface of the film while rotating the work in a state where the film is pressed from its back surface by a shoe toward the work. In addition to a mechanism for pressing a shoe toward a work via film, lapping apparatus has a mechanism for rotationally driving the work, and an oscillation mechanism for applying oscillation in an axial direction of the work to at least one of the work and lapping film (see FIG. 1 and FIG. 2 of Japanese Patent Application Laid-Open No. 7-237116).

Works include one having a pre-machined surface formed with an open holed portion. For example, pin portions and journal portions of a crankshaft are formed with lubricant holes as holed portions penetrating the crankshaft in a direction perpendicular to the axial direction of the crankshaft, respectively. Such lubricant holes are to preferably have mouth-base edges in cross-sectionally rounded shapes, respectively, so as not to damage the engaged components (such as bearing metal).

Thus, mouth-base edges of lubricant holes have been conventionally formed with rounded portions, by conducting additional machining for pressing abrasive-grained surfaces of lapping films to mouth bases of lubricant holes of a work by so-called soft shoes, after once lapping the work by pressing abrasive-grained surfaces of lapping films to the pre-machined surfaces of the work by so-called hard shoes, respectively.

SUMMARY OF THE INVENTION

However, because such machining by the hard shoes is conducted independently of the machining by the soft shoes, it is required to prepare a lapping apparatus having hard shoes and another lapping apparatus having soft shoes, thereby deteriorating a machining efficiency and requiring a relatively longer machining time. Further, the increased number of equipments causes increased equipment cost, machining cost and the like.

Moreover, since the machining by soft shoes is conducted after improving shape accuracies (such as circularity and straightness) of pre-machined surfaces by machining based on hard shoes, the shape accuracies of the pre-machined surfaces may be considerably deteriorated due to the machining by the soft shoes.

Furthermore, the lapping films may excessively bite into the mouth-base edges of lubricant holes upon machining by soft shoes, thereby possibly and exemplarily causing separation of abrasive grains.

Meantime, in the conventional lapping apparatus, the shoe pressing force, work rotational speed and oscillation speed are kept constant during lapping.

Relatedly and in case of a work having a pre-machined surface in a cross-sectionally non-circular shape, radii from the axis (center of rotation) to the pre-machined surface are different region by region. For example, each cam-lobe portion of a camshaft is provided with a plurality of regions exemplarily including a base region establishing a base circle (reference circle), a top region defining a lift of the cam, and event regions extending from the base region to the top region, such that the radius from the axis of the work becomes longer from the end of the base region toward the top region.

Since circumferential speeds vary proportionally to radii when angular velocities are constant, the contact time per unit circumferential length of the outer peripheral surface as the pre-machined surface of the work with a film becomes different region by region when the rotational speed of the work is constant. In this situation, also the contact surface pressure of the film against the pre-machined surface becomes different region by region.

This leads to non-uniform machined amounts per unit circumferential length at the pre-machined surface of the cam-lobe portion, thereby resultingly causing a problem of non-uniform surface roughness of the pre-machined surface. Particularly, the surface roughness of the event regions becomes larger than that of the top region and base region. Since these event regions are important ones for exemplarily starting to open and close valves of an engine, larger surface roughness may possibly obstruct a smooth operation of the valves.

The present invention has been carried out to solve the problems accompanying to the above-mentioned related art. Therefore, it is an object of the present invention to provide a lapping apparatus and a lapping method capable of rapidly machining even a work having a pre-machined surface formed with an open holed portion such as a lubricant hole, of fully restricting increase of machining cost and deterioration of shape accuracy (such as circularity and straightness), and of reducing separation of abrasive grains from a lapping film.

It is another object of the present invention to provide a lapping apparatus and a lapping method capable of uniformalizing machined amounts per unit circumferential length at a pre-machined surface of a work, thereby equalizing the surface roughness of the pre-machined surface.

The first aspect of the present invention provides a lapping apparatus lapping a work having a pre-machined surface, comprising: a lapping film which includes a thin substrate having a surface provided with abrasive grains; a shoe disposed at a back surface side of the lapping film; a shoe driving unit which drives the shoe toward the work in order to press the abrasive-grained surface of the lapping film to the pre-machined surface of the work; a rotational driving unit which drives the work rotationally; a detecting unit which detects the position of the rotating work in the rotating direction; and a controlling unit which controls the pressing force of the shoe driving unit so as to drive the shoe correspondingly to the position of the work in the rotating direction during machining.

The second aspect of the present invention provides a lapping method for lapping a work having a pre-machined surface while rotationally driving the work in a state where an abrasive-grained surface of a lapping film is pressed to the pre-machined surface by a shoe, comprising: detecting a rotational position of the rotating work; and controlling the pressing force of the shoe correspondingly to the position of the work in the rotating direction during machining.

The third aspect of the present invention provides a lapping apparatus lapping a work having a pre-machined surface, comprising: a lapping film which includes a thin substrate having a surface provided with abrasive grains; a shoe disposed at a back surface side of the lapping film; shoe driving means for driving the shoe toward the work in order to press the abrasive-grained surface of the lapping film to the pre-machined surface of the work; rotational driving means for driving the work rotationally; detecting means for detecting the position of the rotating work in the rotating direction; and controlling means for controlling the pressing force of the shoe driving means so as to drive the shoe correspondingly to the position of the work in the rotating direction during machining.

BRIEF DESCRIPTION OF THE DRAWINGS

The invention will now be described with reference to the accompanying drawings wherein;

FIGS. 4A and 4B are cross-sectional views showing essential parts of the lapping apparatus 1, in which FIG. 4A shows a state of a second shoe constituting a soft shoe driven to an operative position where the second shoe is pressed to a mouth base of a lubricant hole, and FIG. 4B shows a state of the soft shoe driven to an inoperative position where the soft shoe is separated away from the mouth base of the lubricant hole;

DETAILED DESCRIPTION OF THE PREFERRED EMBODIMENT

There will be explained hereinafter embodiments of the present invention with reference to the drawings.

First Embodiment

Figure 1:
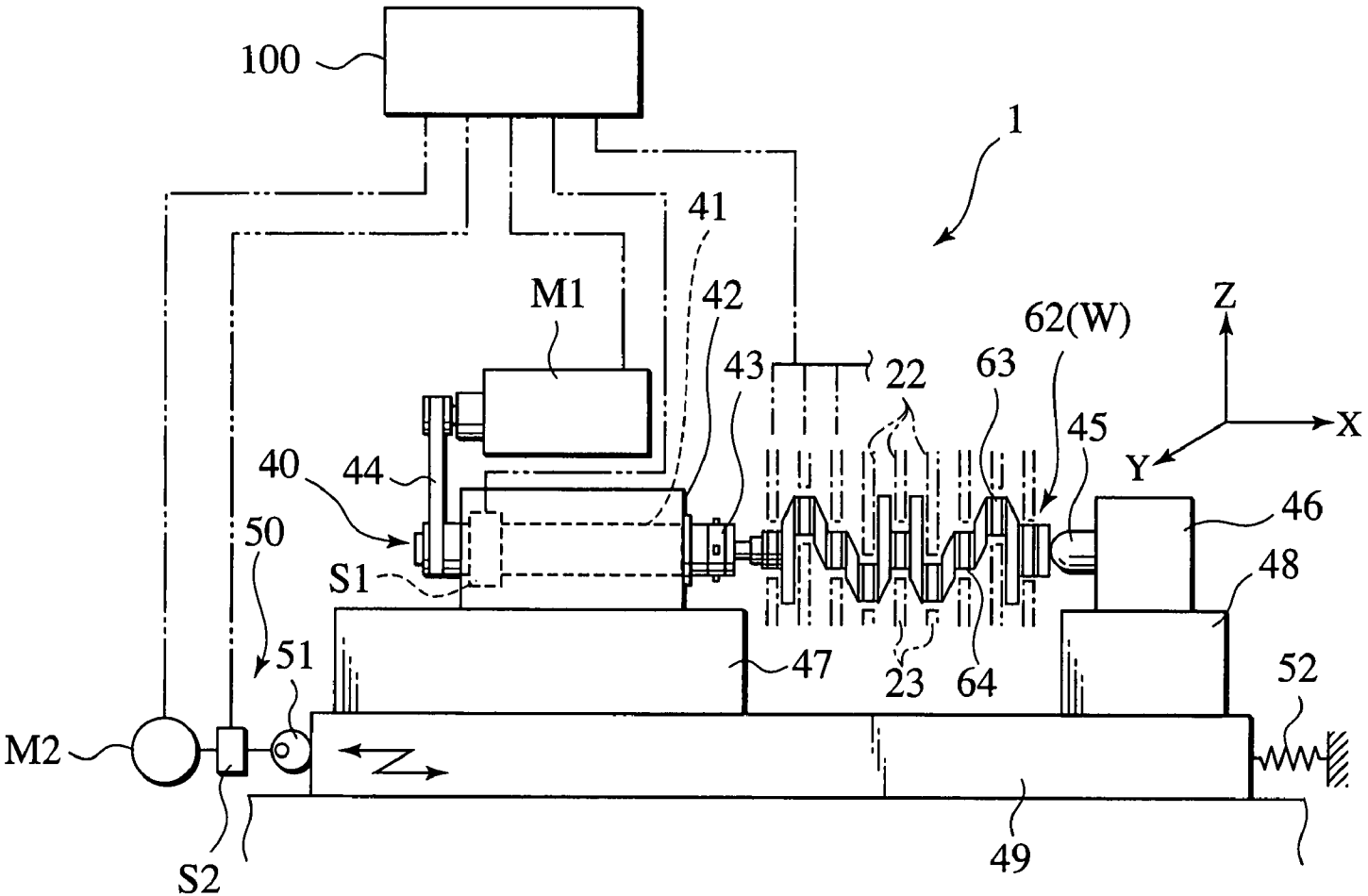
FIG. 1 is a schematic view showing a lapping apparatus according to a first embodiment of the present invention.
Figure 2:
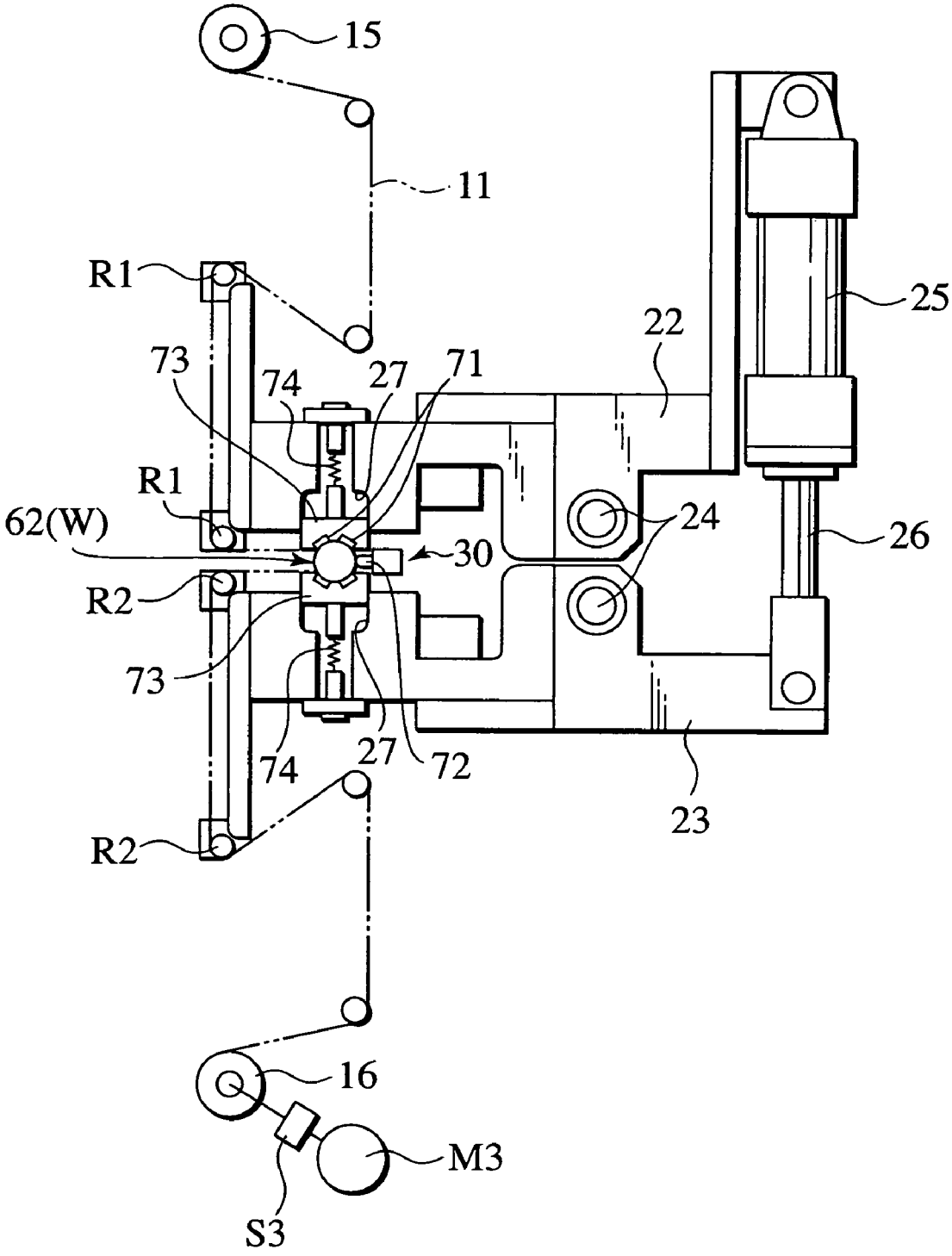
FIG. 2 is a schematic cross-sectional view showing a closed state of upper and lower arms openably and closably provided in the lapping apparatus.
Figure 3:
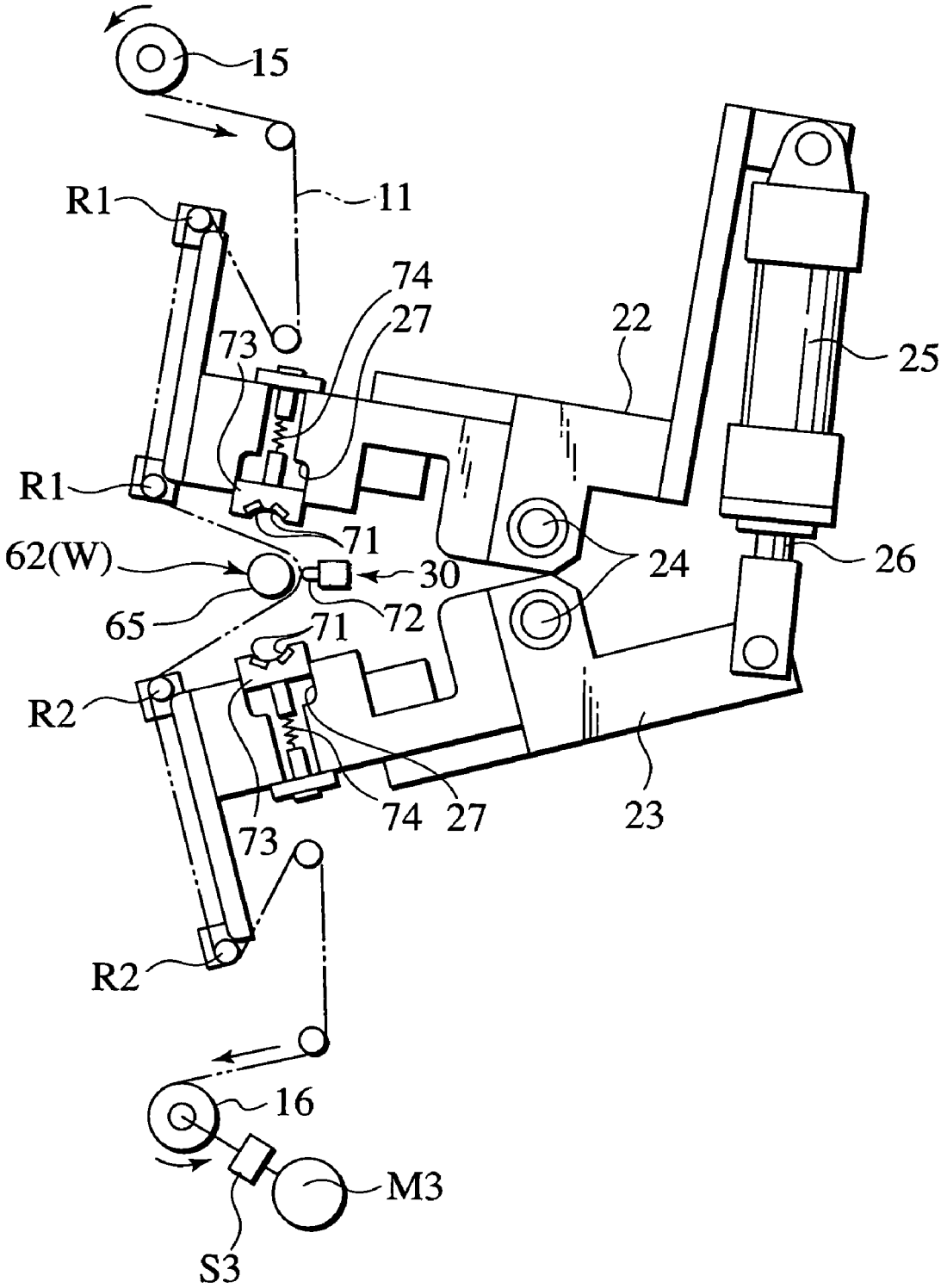
FIG. 3 is a schematic cross-sectional view showing an opened state of the upper and lower arms.
Figure 4A:
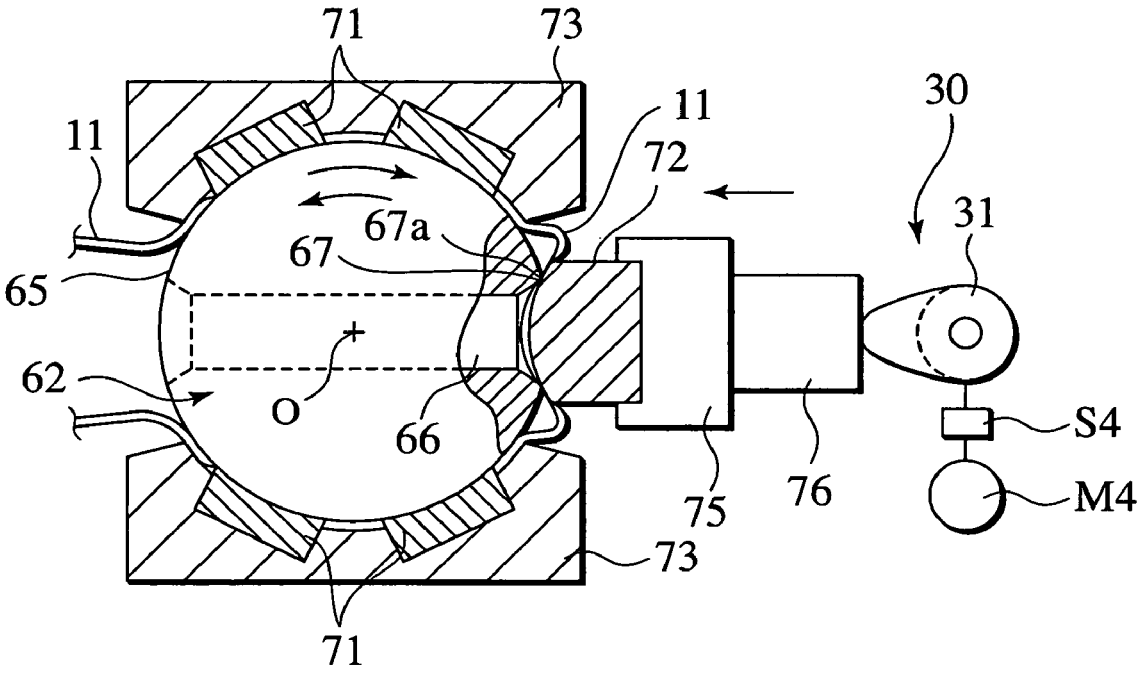
Figure 4B:
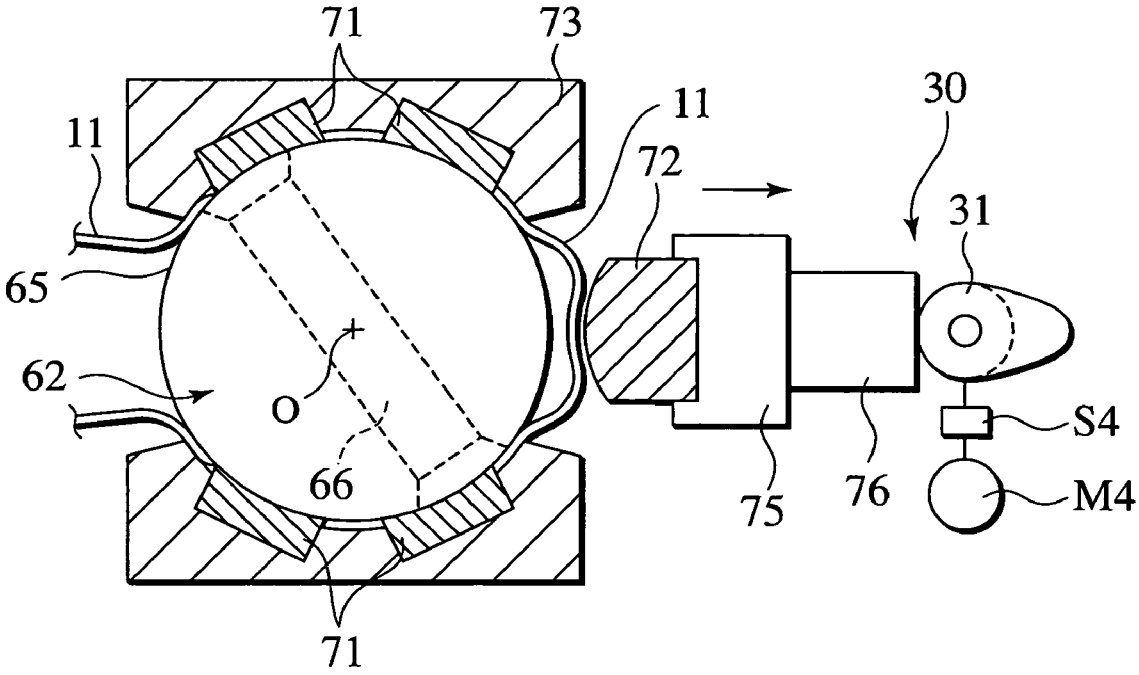

FIG. 1 shows a lapping apparatus 1 according to a first embodiment of the present invention. FIG. 2 shows a closed state of upper and lower arms 22, 23 openably and closably provided in the lapping apparatus 1. FIG. 3 shows an opened state of the upper and lower arms 22, 23. FIGS. 4A and 4B show essential parts of the lapping apparatus 1, in which FIG. 4A shows a state of a second shoe 72 constituting a soft shoe driven to an operative position where the second shoe 72 is urged to a mouth base 67 of a lubricant hole 66, and FIG. 4B shows a state of the soft shoe driven to an inoperative position where the soft shoe is separated away from the mouth base 67 of the lubricant hole 66. FIGS. 5A through 5C and FIGS. 6A through 6 show ranges in which the soft shoe 72 is driven between the inoperative position and operative position. FIG. 7A shows an example of crankshaft 62 as a work W to be lapped, and FIG. 7B shows the lubricant hole 66 formed in the crankshaft 62. As an expediency of explanation, the axial direction of the crankshaft 62 (i.e., the right-and-left direction in FIG. 1) is defined as an X direction, the horizontal direction perpendicular to the X direction (i.e., the direction perpendicular to the drawing plane of FIG. 1) as a Y direction, and the vertical direction perpendicular to the X direction (i.e., the up-and-down direction in FIG. 1) as a Z direction.

Generally, with reference to FIGS. 1 through 4, the lapping apparatus 1 of this embodiment includes: lapping films 11 each comprising an inextensible and deformable thin substrate having one surface provided with abrasive grains; first shoes 71 for pressing abrasive-grained surfaces of the lapping films 11 to pre-machined surfaces 65 of the work W, respectively; second shoes 72 for pressing the abrasive-grained surfaces of the lapping films 11 to mouth bases 67 of holed portions 66 formed in the pre-machined surfaces 65, respectively; shoe driving units 30 for driving the second shoes 72 between operative positions where the second shoes 72 are pressed to the mouth bases 67 of holed portions 66 and inoperative positions where the second shoes 72 are separated away from the mouth bases 67 of the holed portions 66, respectively; a rotational driving unit 40 for rotationally driving the work W; and an oscillation unit 50 for applying oscillation in the axial direction of the work W, to at least one of the work W and lapping films 11; such that the rotating work W is lapped by pressing the lapping films 11 thereto. The lapping apparatus 1 of this embodiment is preferably utilized to lap the work W having the pre-machined surfaces 65 formed with open holed portions 66, respectively. This type of works W include the crankshaft 62 shown in FIG. 7A, and outer peripheral surfaces of pin portions 63 and journal portions 64 of this crankshaft 62 exemplarily establish the pre-machined surfaces 65 to be lapped. As shown in FIG. 7B, each of the pin portions 63 and journal portions 64 of the crankshaft is formed with a lubricant hole as the holed portion 66 in a manner to penetrate the crankshaft in the direction perpendicular to the axial direction of the crankshaft, and the mouth base 67 of the lubricant hole 66 opens at the pre-machined surface 65. Multiple pairs of coupled upper and lower arms 22, 23 are provided corresponding to the positions of pin portions 63 and journal portions 64 (see FIG. 1).

The lapping apparatus 1 will be described hereinafter in detail.

Referring to FIG. 1, the rotational driving unit 40 includes: a headstock 42 for rotatably supporting a main shaft 41; a chuck 43 coupled to a tip end of the main shaft 41 so as to grip one end of the crankshaft 62; a main-shaft-aimed motor M1 connected to the main shaft 41 via belt 44; and a tailstock 46 provided with a center 45 for supporting the other end of the crankshaft 62. The rotational movement of the main-shaft-aimed motor M1 is transmitted to rotationally drive the crankshaft 62 via belt 44 and main shaft 41. Changing the rotational speed of the main-shaft-aimed motor M1 causes a work rotational speed Vw to be set at a desired speed. To detect positions of the lubricant holes 66 of the rotating crankshaft 62, the main shaft 41 is attached with a rotary encoder S1 for detecting the rotational position of the work W during machining. The headstock 42 and tailstock 46 are disposed on tables 47, 48 slidably movable in the Y direction, respectively, while these tables 47, 48 are arranged on a table 49 slidably movable in the X direction. These tables 47, 48, 49 are moved to exemplarily set the crankshaft 62 between the headstock 42 and tailstock 46, and to move the crankshaft 62 to the machining position.

The oscillation unit 50 includes an eccentric rotor 51 abutting on an end surface of the table 49, and an oscillation motor M2 for rotationally driving the eccentric rotor 51. The oscillation unit 50 is provided with an elastic unit 52 such as a spring for applying a reactive elastic force for pressing the table 49 toward the eccentric rotor 51 so as to normally abut the eccentric rotor 51 onto the end surface of the table 49. Changing the rotational speed of the oscillation motor M2 causes an oscillation speed Vo to be set at a desired speed (such as 10 Hz). The amplitude of the oscillation is determined based on an eccentricity amount of the eccentric rotor 51 relative to the axis of the oscillation motor M2. This eccentricity amount is about 1 mm, and the amplitude of the oscillation is about 2 mm. Note, the eccentricity amount of the eccentric rotor 51 is adjustable, by a technique such as a variable number of inserted adjusting plates (not shown). The eccentric rotor 51 has a shaft attached with a rotary encoder S2 for detecting the rotational position of the eccentric rotor 51.

While various types of lapping films 11 are existent, the lapping film 11 in this embodiment is constituted of: a substrate comprising a material having an extremely inextensible property such as polyester having a thickness of 25 μm to 130 μm; and numerous abrasive grains (concretely, aluminum oxide, silicon carbide, diamond and the like) having particle sizes on the order of several μm to 200 μm, attached to one surface of the substrate by an adhesive. The abrasive grains may be adhered the one surface of the substrate over the whole thereof, or leaving intermittently defined areas of predetermined widths having no abrasive grains thereon. For avoiding slippage relative to the first and second shoes 71, 72, the other surface of the substrate is applied with a back coating comprising a resistive material (not shown) such as rubber or synthetic resin, or applied with an antislipping treatment as the case may be.

Referring to FIG. 2 and FIG. 3, each lapping film 11 is drawn out of an associated feeding reel 15 while being exemplarily guided by a pair of first guiding rollers R1 disposed at a tip end of the associated upper arm 22 and a pair of second guiding rollers R2 disposed at a tip end of the associated lower arm 23, and then wound up by an associated wind-up reel 16. A motor M3 is connected to the wind-up reel 16. Operating the motor M3 to rotate the associated wind-up reel 16 successively draws the lapping film 11 from the feeding reel 15. To detect the drawn out amount of the lapping film 11, the shaft of the wind-up reel 16 is attached with a rotary encoder S3 for detecting the rotated amount of the wind-up reel 16. Provided near the feeding reel 15 and wind-up reel 16 are locking devices (not shown), and the operations of these locking devices apply a predetermined tension to the whole of the film 11.

The coupled upper arm 22 and lower arm 23 of each pair are pivotably disposed via supporting pins 24, respectively, such that the tip ends of these arms arranged with the first shoes 71 and second shoe 72 are relatively openable and closable in the Z direction. The upper arm 22 has a rear end portion pin-coupled with one end of a fluid pressure cylinder 25 such as operated by oil pressure or air pressure, and the lower arm 23 has a rear end portion pin-coupled with a tip end of a piston rod 26. Expanding the piston rod 26 from its contracted state pivots the upper and lower arms 22, 23 in directions for closing the tip end portions of these arms around the supporting pins 24, respectively, into the closed state shown in FIG. 2. Contrary, contracting the piston rod 26 from its expanded state pivots the upper and lower arms 22, 23 in a direction for opening the tip end portions of these arms, into the opened state shown in FIG. 3. Pivotal movements of the upper and lower arms 22, 23 are conducted consonantly with the associated lapping film 11, such that the closing pivotal movement causes the first shoes 71 to abut on the pre-machined surface 65 via lapping film 11, and the opening pivotal movement releases the abutment of the first shoes 71 on the pre-machined surface 65.

In the illustrated embodiment, the first shoes 71 comprise hard shoes and the second shoe 72 comprises a soft shoe. Each hard shoe 71 is formed of a hard material such as grindstone or steel. Each lapping film 11 is backed up by the hard shoes 71 and the abrasive-grained surface of the lapping film 11 is pressed to the pre-machined surface 65, thereby finishing the pre-machined surface 65 as a cylinder surface with a higher shape accuracy (such as circularity and straightness). Meantime, the soft shoe 72 is formed of a material such as urethane, which is softer than the hard shoe 71 and is elastically deformable. The soft shoe 72 is elastically deformed, and contacts with the pre-machined surface 65 through a relatively wide area, actually via film 11. Although the soft shoe 72 has a lower ability to correct the work shape than the hard shoes 71, this soft shoe has a superior function for reducing the surface roughness of the pre-machined surface 65. In the first embodiment, this soft shoe 72 is used to form a rounded portion 68 at each mouth-base edge 67*a* (see FIG. 7B). In the present specification, the indirect abutment of the shoe on the outer peripheral surface of the work W via film 11 is abbreviated to "contact".

While the shoes are classified into concave shoes and convex shoes, each hard shoe 71 is a concave one having a concave tip end portion and each soft shoe 72 is formed into a convex one having a convex tip end portion. The soft shoe 72 of this embodiment is preferably one specifically used to form the rounded portion 68 at the mouth-base edge 67*a*, such as a convex shoe having a spherical shape.

The hard shoes 71 are plurally attached to shoe cases 73 having inner peripheral surfaces opposing to the pre-machined surface 65, respectively. In the illustrated embodiment, two hard shoes are attached to each of upper and lower shoe cases 73. The shoe cases 73 are housed in concaves 27 formed at the tip end portions of the upper and lower arms 22, 23, respectively, in a manner capable of advancing and retracting relative to the work W. Each shoe case 73 is moved while its outer surface is guided by an inner surface of the associated concave 27. Further, each shoe case 73 has a back surface arranged with a work clamping spring 74 comprising a compression coil spring. The hard shoes 71 are applied with reactive elastic forces of the work clamping springs 74 and pressed to the pre-machined surface 65 via lapping film 11, respectively.

As shown in FIGS. 4A and 4B, the soft shoe 72 is attached to a tip end of a shoe holder 75, and arranged in a +X direction in these figures (right side of these figures) relative to the crankshaft 62. The shoe holder 75 is attached to a tip end of a rod 76 in a manner capable of advancing and retracting in the X direction of these figures intersecting an axis O (i.e., center of rotation) of the crankshaft 62. The rod 76 advances and retracts between an advanced limit position (i.e., the state shown in FIG. 4A) adjacent to the crankshaft 62 and a retracted limit position (i.e., the state shown in FIG. 4B) separated from the crankshaft 62.

As conceptually shown in FIGS. 4A and 4B, each shoe driving unit 30 includes: a rotatable eccentric cam 31 abutting on the rear end of the rod 76; a motor M4 for rotationally driving the eccentric cam 31; and an elastic unit (not shown) for keeping a state where the rear end of the rod 76 normally abuts on the eccentric cam 31. As shown in FIG. 4A, when the eccentric cam 31 rotates and its top region abuts on the rear end of the rod 76, the rod 76 is moved to the advanced limit position. This causes the soft shoe 72 to reach an operative position where the soft shoe 72 is pressed to the mouth base 67 of the applicable lubricant hole 66 so that the abrasive-grained surface of the lapping film 11 is pressed to the mouth base 67. Contrary, as shown in FIG. 4B, when the base region of the eccentric cam 31 abuts on the rear end of the rod 76, the rod 76 is moved to its retracted limit position. This causes the soft shoe 72 to reach an inoperative position where the soft shoe 72 is separated away from the mouth base 67 of the lubricant hole 66 so that the press of the lapping film 11 to the mouth base 67 is released. To detect the positions (operative position and inoperative position) of the soft shoe 72, the shaft of the eccentric cam 31 is attached with a rotary encoder S4 for detecting the rotational position of the eccentric cam 31.

The dimensions of the eccentric cam 31 such as cam lift and base circle diameter are determined based on the moving distance of the rod 76, i.e., the moving distance of the soft shoe 72, the pressing force of the soft shoe 72, and the like. Further, the position of center of rotation of the eccentric cam 31 is made adjustable in the X direction in the applicable figure, so that the pressing force of the soft shoe 72 can be adjusted even by using the same eccentric cam 31.

Figure 5A:
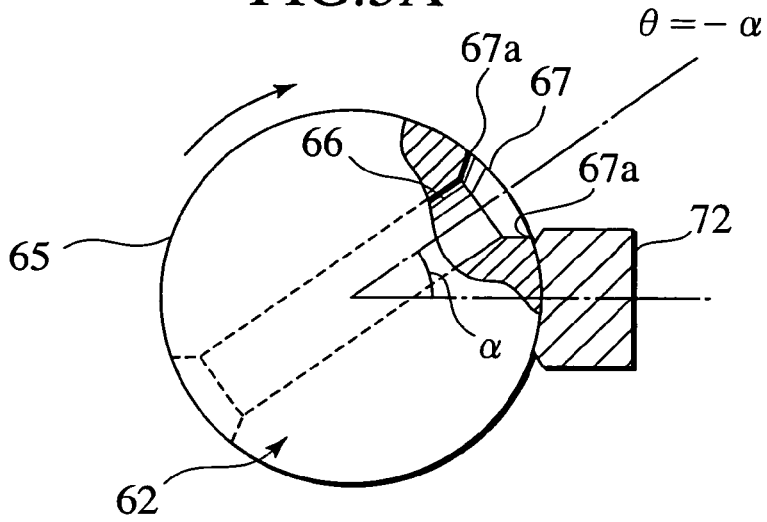
FIGS. 5A through 5C are explanatory views of a range in which the soft shoe is driven from the inoperative position to the operative position.
Figure 5B:
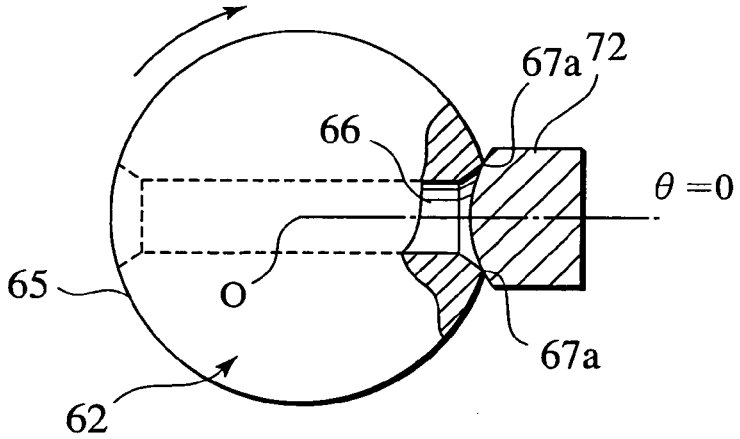
Figure 5C:
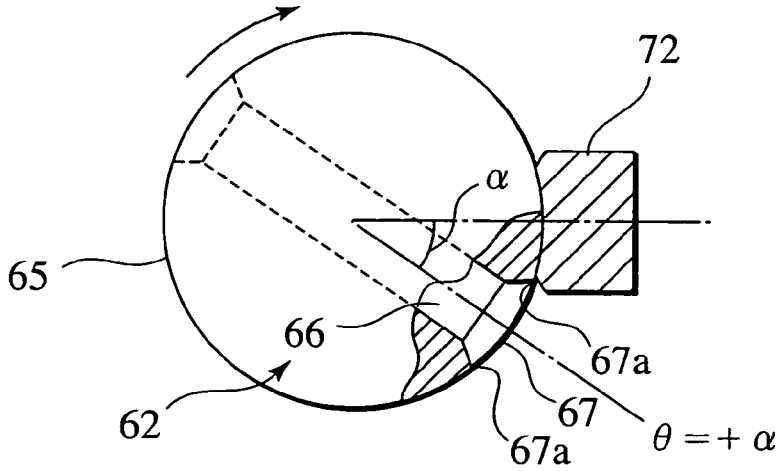
Figure 6A:
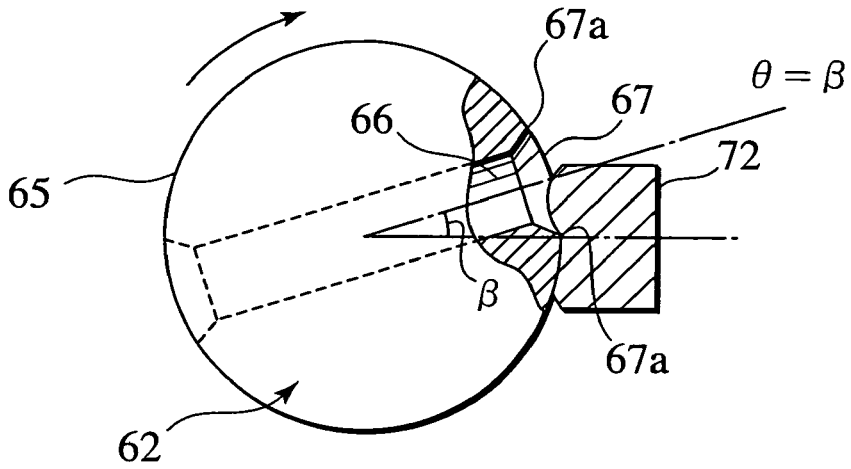
FIGS. 6A through 6C are explanatory views of a range in which the soft shoe is driven from the inoperative position to the operative position.
Figure 6B:
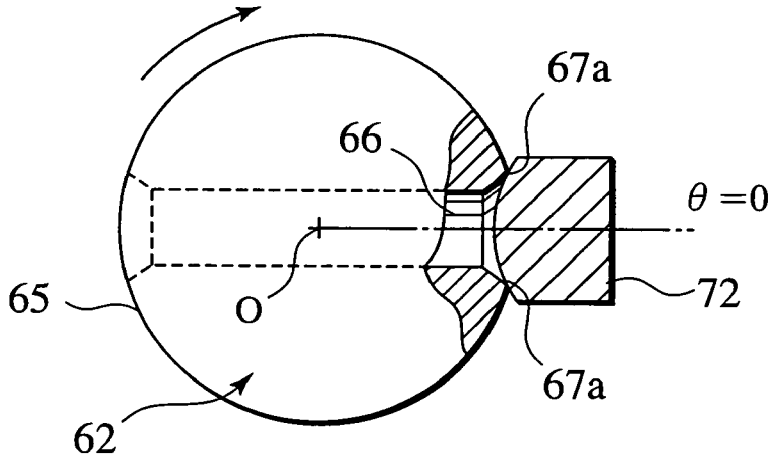
Figure 6C:
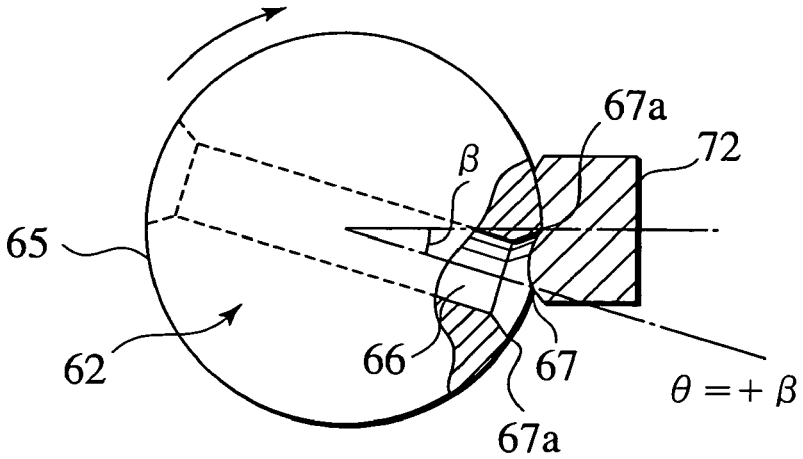
Figure 7A:
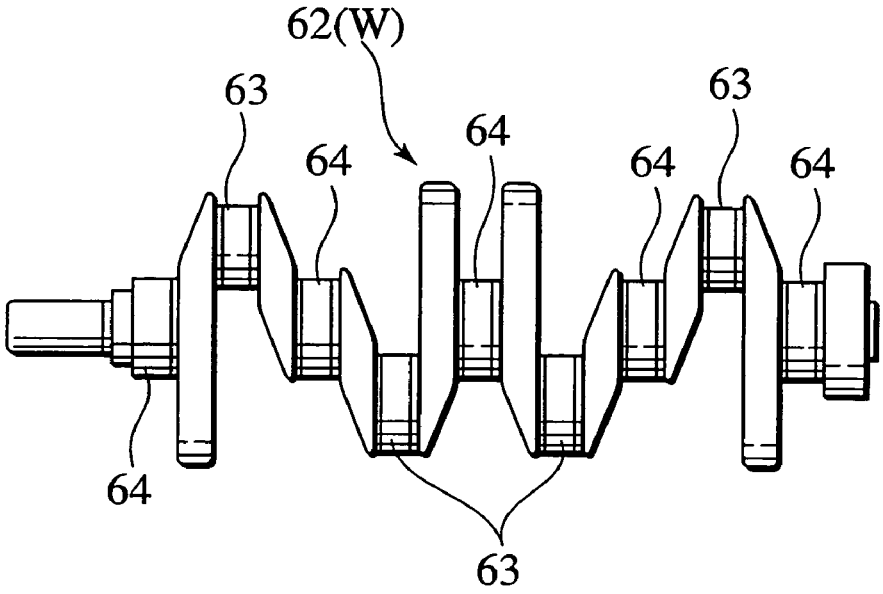
FIG. 7A is a perspective view showing an example of crankshaft as a work to be lapped.
Figure 7B:
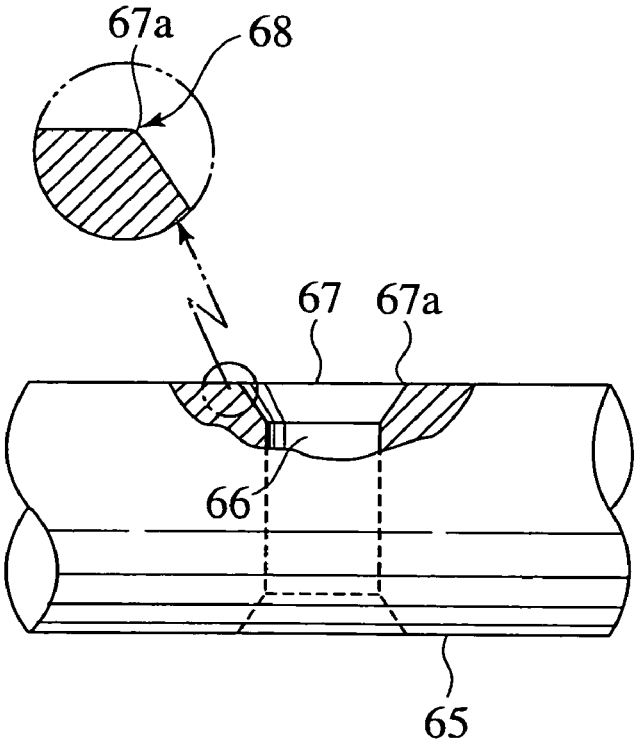
FIG. 7B is a partially cut-away cross-sectional view of a lubricant hole formed in the crankshaft.

Referring to FIGS. 5A through 5C and FIGS. 6A through 6C, there will be explained a range in which the soft shoe 72 is driven from the inoperative position to the operative position. In these figures, the crankshaft 62 is assumed to rotate clockwise as indicated by arrows. Further, as shown in FIG. 5B and FIG. 6B, there is defined a reference position of the crankshaft 62 where the axis of the lubricant hole 66 forms an angle θ of zero relative to an X direction in these figures, i.e., the position where the axis of the lubricant hole 66 becomes parallel to the X direction.

It is ideal that the timing for driving the soft shoe 72 from its inoperative position to its operative position is only a moment where the rotating crankshaft 62 has just reached the reference position. However, since the crankshaft 62 is normally rotated, simply driving the soft shoe 72 to its operative position only at the moment where the crankshaft 62 has reached the reference position, may fail to uniformly machine the entire circumference of the mouth base 67 of the lubricant hole 66 even with a slight synchronous discrepancy between the rotation of the crankshaft 62 and the movement of the soft shoe 72. As such, it is desirable to drive the soft shoe 72 to its operative position before the crankshaft 62 reaches the reference position, and to hold the soft shoe 72 at the operative position even after the crankshaft 62 has reached the reference position.

The lapping for the mouth base 67 is effected while the soft shoe 72 contacts with the mouth base 67. This makes it enough for the soft shoe 72 to be driven to its operative position, only within a rotational angle range of the crankshaft 62 where a certain portion of the mouth base 67 is allowed to contact the soft shoe 72 in this operative position. It is assumed here that the leading portion of the mouth base 67 in the rotating direction abuts onto the soft shoe 72 at a rotational angle of $\theta=-\alpha°$ before the crankshaft 62 reaches the reference position ($\theta=0°$) as shown in FIG. 5A, and that the trailing portion of the mouth base 67 in the rotating direction leaves the soft shoe 72 at a rotational angle of $\theta=+\alpha°$ after the crankshaft 62 has reached the reference position as shown in FIG. 5C. In this case, it is possible for the soft shoe 72 to be driven to its operative position throughout the range of $2\alpha°$ where the crankshaft 62 is rotated from $\theta=-\alpha°$ to $\theta=+\alpha°$.

Nonetheless, the lapping to be performed by pressing the lapping film 11 by the soft shoe 72 is preferably delimited to the mouth base 67 itself of the lubricant hole 66 and the vicinity of the mouth base 67. This is to prevent the shape accuracy (such as circularity and straightness) of the pre-machined surface 65 from being deteriorated due to machining by the soft shoe 72. It is thus desirable to drive the soft shoe 72 to its operative position, within a range narrower than the above range ($2\alpha°$). As conceptually shown in FIGS. 6A through 6C, it is preferable to drive the soft shoe 72 to its operative position within a range of $2\beta°$, from a rotational angle $\theta=-\beta°$ ($\beta<\alpha$) before the crankshaft 62 reaches the reference position (θ=0°) to a rotational angle θ=+β° after the crankshaft 62 has reached the reference position.

In the lapping apparatus 1 of this embodiment, the rotational position of the crankshaft 62 is detected by the rotary encoder S1 in order to detect the position of each lubricant hole 66 of the rotating crankshaft 62, and the operation of the associated driving unit 30 is controlled to drive the associated soft shoe 72 to its operative position or inoperative position correspondingly to the position of the associated lubricant hole 66 during machining, so that the lapping to be performed by pressing the lapping film 11 by the soft shoe 72 is delimited to the vicinity of the mouth base 67 of the lubricant hole 66.

The above control will be explained with reference to FIG. 8 which is a block diagram showing a control system of the lapping apparatus 1 according to the present invention.

Figure 8:
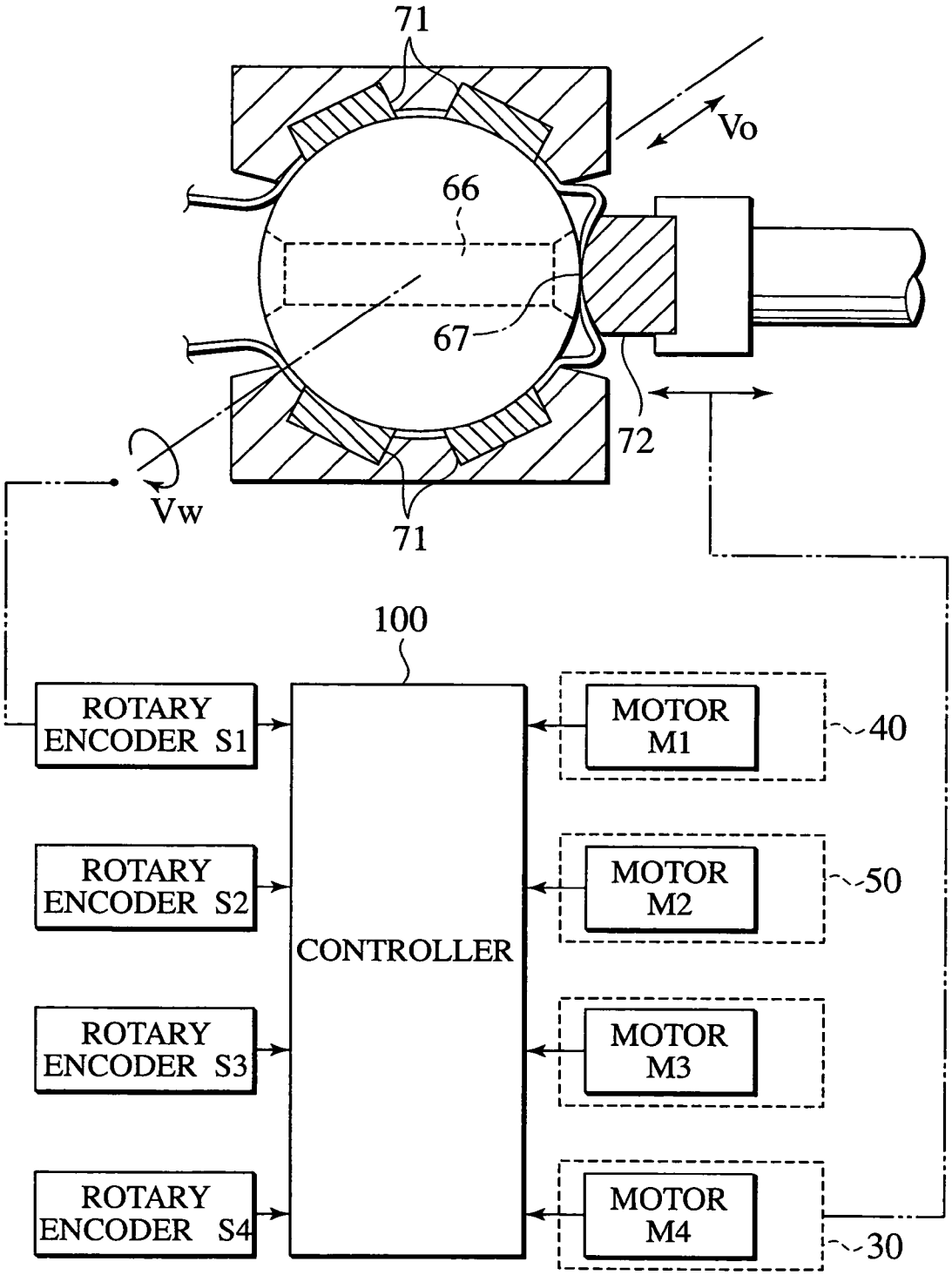
FIG. 8 is a schematic block diagram showing a control system of the lapping apparatus according to the present invention.

Referring to FIG. 8, the rotary encoders S1, S2, S3 and S4 are connected to a controller 100 (corresponding to a controlling unit) such as mainly comprising a CPU and a memory, and the controller 100 is inputted with detecting signals such as concerning the rotational position of the crankshaft 62 and the rotational position of each eccentric cam 31 for changing the position of the associated soft shoe 72 during machining. The controller 100 is also inputted with detecting signals concerning the rotational speed of the main-shaft-aimed motor M1 for determining the work rotational speed Vw, and the rotational speed of the oscillation motor M2 for determining the oscillation speed Vo. The controller 100 decides the positions of the lubricant holes 66, respectively, based on the signal from the rotary encoder S1 concerning the rotational position of the crankshaft 62. Further, the controller 100 variably controls the positions of the soft shoes 72 to operative positions or inoperative positions, respectively, correspondingly to the positions of the associated lubricant holes 66 during machining.

The changing control of positions of the soft shoes 72 is conducted by controlling the operations of the shoe driving units 30 including the eccentric cams 31 and motors M4, such that the soft shoes 72 are brought into and out of the associated mouth bases 67 synchronizedly with the positions of the lubricant holes 66, respectively.

Concretely, the controller 100 outputs controlling signals to the motors M4 for controlling rotations thereof, such that the top region of each applicable eccentric cam 31 abuts on the rear end of each associated rod 76 when the rotating crankshaft 62 has reached the applicable reference position (θ=0°). This causes each soft shoe 72 to reach its operative position in order to press the abrasive-grained surface of the associated lapping film 11 to the associated mouth base 67, thereby forming the rounded portion 68 at the mouth-base edge 67*a*. The radius of each rounded portion 68 is exemplarily on the order of 10 μm to 20 μm.

There will be explained hereinafter an operation of this embodiment.

Firstly, the crankshaft 62 is supported between the headstock 42 and tailstock 46, and the upper and lower arms 22, 23 are moved to positions of the pin portions 63 and journal portions 64, respectively. At this time, the fluid pressure cylinders 25 have contracted the associated piston rods 26 in order to hold the associated upper arms 22 and lower arms 23 at the opened positions, respectively. Thereafter, the fluid pressure cylinders 25 are operated to expand the associated piston rods 26, thereby pivoting the upper and lower arms 22, 23 in the closing directions, respectively. These closing pivotal movements cause the lapping films 11 to be set on the pre-machined surfaces 65, respectively.

While the upper and lower arms 22, 23 are pivoted and closed, the motors M3 are operated to rotate the wind-up reels 16, respectively. The lapping films 11 are fed by predetermined amounts so that unused abrasive-grained surfaces are set onto the pre-machined surfaces 65, respectively. Thereafter, the wind-up reels 16 are rotated after locking the feeding reels 15 by the locking devices near them, so that the lapping films 11 are applied with predetermined tensions. Next, the wind-up reels 16 are locked by the locking devices near them, thereby bringing the lapping films 11 into states applied with tensions without any slack.

Further, upon clamping the crankshaft 62, the hard shoes 71 are applied with the reactive elastic forces of the associated work clamping springs 74 and pressed to the pre-machined surfaces 65, respectively.

Moreover, the crankshaft 62 is rotated around its axis by operating the rotational driving unit 40 while applying oscillation to the crankshaft 62 along the axial direction thereof by operating the oscillation unit 50, so that the abrasive-grained surfaces of lapping films 11 are pressed to the pre-machined surfaces 65 by the hard shoes 71, respectively, thereby lapping the pre-machined surfaces 65 throughout the whole thereof. The machining for the whole of the pre-machined surfaces 65 is conducted by the hard shoes 71, thereby improving the machining efficiency.

During this machining, the controller 100 controls the operations of the shoe driving units 30 to synchronize the movements of the soft shoes 72 with the rotation of the crankshaft 62. The rotary encoder S1 detects the rotational position of the crankshaft 62, and the controller 100 decides the positions of the lubricant holes 66 based on the rotational position of the crankshaft 62 so as to variably control the positions of the soft shoes 72 to the operative positions or inoperative positions correspondingly to the positions of the associated lubricant holes 66 during machining, respectively. Namely, the controller 100 controls the operations of the motors M4 to rotate the eccentric cams 31 such that the top region of each applicable eccentric cam 31 abuts on the rear end of each associated rod 76 when the rotating crankshaft 62 has reached the applicable reference position (θ=0°).

This causes each soft shoe 72 to reach its operative position in order to press the abrasive-grained surface of the associated lapping film 11 to the associated mouth base 67, thereby forming the rounded portion 68 at the mouth-base edge 67*a*.

During the lapping, the crankshaft 62 is forwardly rotated by a predetermined number of revolutions (such as 5 revolutions), and thereafter rearwardly rotated by the same number of revolutions. Changing the rotating direction eliminates clogging due to lapping films 11, maintains the due performance, and causes the entire circumferences of the mouth bases 67 to be uniformly machined.

In this way, the machining for the entire circumferences of the pre-machined surfaces 65 by the hard shoes 71 and the machining for the mouth bases 67 by the soft shoes 72 are conducted by the single set of lapping apparatus, thereby enabling to improve the machining efficiency and to shorten the time required for the machining. Further, the number of equipments is not increased, thereby also allowing to restrict an increase of equipment cost and machining cost.

Moreover, the lapping to be conducted by pressing the lapping film 11 by the associated soft shoe 72 is delimited to the vicinity of the mouth base 67 of the associated lubricant hole 66, thereby excluding a risk that the shape accuracy (such as circularity and straightness) of each pre-machined surface 65 is deteriorated due to machining by the soft shoe 72. Further, since the machining by the hard shoes 71 for improving the shape accuracy (such as circularity and straightness) of each pre-machined surface 65 and the machining by the associated soft shoe 72 for forming the rounded portion 68 at the mouth-base edge 67*a* are conducted in the same process, the function by the hard shoes 71 for correcting the work shape is to be also effected to those sites having been machined by the soft shoe 72. Also from this standpoint, there is no risk that the shape accuracy of each pre-machined surface 65 is deteriorated due to the machining by the associated soft shoe 72.

Figure 9:
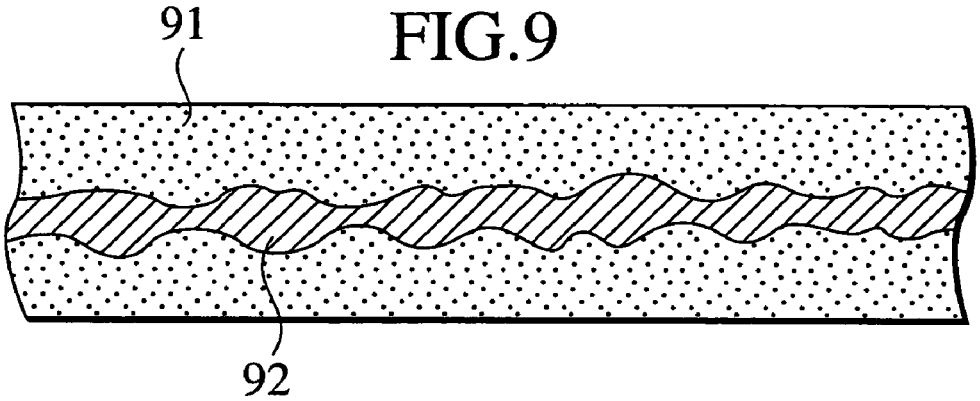
FIG. 9 is a view showing an exemplary trouble of partially separated abrasive grain layer of a lapping film.

In case of a comparative example where additional machining for pressing an abrasive-grained surface of a lapping film to the mouth base 67 by a soft shoe is conducted after machining by hard shoes, the lapping film excessively bites into the mouth-base edge 67*a* upon machining by the soft shoe, thereby exemplarily causing separation of abrasive grains. FIG. 9 shows an exemplary trouble of partially separated abrasive grain layer of a lapping film 91. As illustrated, there has been caused a separation area 92 at a substantially central portion in the widthwise direction of the lapping film 91 and extending like a belt in the film feeding direction.

Contrary, since the lapping by the soft shoe 72 is delimited to the vicinity of the mouth base 67 of each lubricant hole 66, the lapping film 11 does not excessively bite into the mouth-base edge 67*a*, thereby reducing separation of abrasive grains from the lapping film 11 and reducing the number of locations of separation.

While the crankshaft 62 has many pin portions 63 and journal portions 64, the lapping is simultaneously conducted for these pin portions 63 and journal portions 64. Upon completing the lapping, the fluid pressure cylinders 25 are operated to contract the associated piston rods 26 in order to pivot the upper and lower arms 22, 23 in the opening directions, respectively, into states where the crankshaft 62 can be taken out of them. After taking out the crankshaft 62, another crankshaft 62 is set, thereby enabling to start the same lapping.

As described above, the lapping apparatus 1 according to the first embodiment includes: the lapping films 11; the first shoes 71 for pressing the abrasive-grained surfaces of the lapping films 11 to the pre-machined surfaces 65, respectively; the second shoes 72 for pressing the abrasive-grained surfaces of the lapping films 11 to the mouth bases 67 of the lubricant holes 66 as the holed portions, respectively; the shoe driving units 30 for driving the second shoes 72 between the operative positions where the second shoes 72 are pressed to the mouth bases 67 of the lubricant holes 66, respectively, and the inoperative positions where the second shoes 72 are separated away from the mouth bases 67 of the lubricant holes 66, respectively; the rotational driving unit 40 for rotationally driving the work W; the rotary encoder S1 for detecting the rotational position of the work W in order to detect the positions of lubricant holes 66 of the rotating work W; and the controller 100 for controlling the operation of the shoe driving units 30 so that the second shoes 72 are driven to the operative positions or inoperative positions correspondingly to the positions of the lubricant holes 66 during machining, respectively. Further, the lapping to be conducted by pressing the lapping films 11 by the second shoes 72 is delimited to the vicinity of the mouth bases 67 of the lubricant holes 66. Thereby, the lapping apparatus 1 according to the first embodiment exhibits such an effect that even a work W having pre-machined surfaces 65 formed with opened lubricant holes 66 can be rapidly machined while enabling to fully restrict increase of machining cost and deterioration of shape accuracy (such as circularity and straightness), and to reduce separation of abrasive grains from the lapping films 11 as well as the number of locations of separation.

Further, since the first shoes 71 comprise hard shoes and the second shoes 72 comprise soft shoes, the machining by the hard shoes 71 for improving the shape accuracy (such as circularity and straightness) of each pre-machined surface 65 and the machining by the associated soft shoe 72 for forming the rounded portion 68 at the mouth-base edge 67*a* are conducted in the same process, so that the function by the hard shoes 71 for correcting the work shape is to be also effected to those sites having been machined by the soft shoe 72. Thus, there is no risk that the shape accuracy of each pre-machined surface 65 is deteriorated due to the machining by the associated soft shoe 72.

Moreover, the holed portions exemplarily comprise the lubricant holes 66, so that the pre-machined surfaces 65 of pin portions 63, journal portions 64 and the like of the crankshaft 62 having such lubricant holes 66 can be preferably lapped.

Furthermore, the lapping film 11 is inextensible and deformable, thereby allowing the work W to be preferably lapped.

The lapping apparatus 1 of this embodiment embodies a lapping method for lapping a work W having pre-machined surfaces 65 formed with opened lubricant holes 66 while rotationally driving the work W in a state where the abrasive-grained surfaces of the lapping films 11 are pressed to the pre-machined surfaces 65 by the first shoes 71, respectively, comprising the steps of: detecting positions of the lubricant holes 66 of the rotating work W, by the rotary encoder S1; and driving, the second shoes 72 for pressing the abrasive-grained surfaces of the lapping films 11 to the mouth bases 67 of the lubricant holes 66, to the operative positions pressed to the mouth bases 67 of the lubricant holes 66 or to the inoperative positions separated away from the mouth bases 67 of the lubricant holes 66 correspondingly to the positions of the lubricant holes 66 during machining, respectively, such that the lapping to be conducted by pressing the lapping films 11 by the second shoes 72 is delimited to the vicinity of the mouth bases 67 of the lubricant holes 66. Thereby, the lapping apparatus 1 of this embodiment exhibits such an effect that even a work W having pre-machined surfaces 65 formed with opened lubricant holes 66 can be rapidly machined while enabling to fully restrict increase of machining cost and deterioration of shape accuracy (such as circularity and straightness), and to reduce separation of abrasive grains from a lapping film as well as the number of locations of separation.

Second Embodiment

Figure 11A:
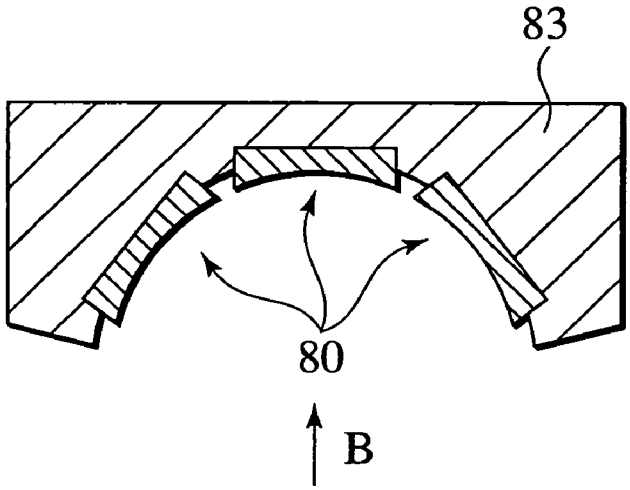
FIG. 11A is a cross-sectional view showing shoes and a shoe case to be used in the second embodiment.
Figure 11B:
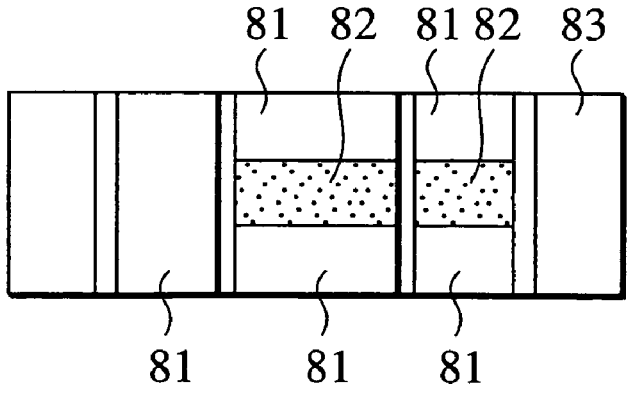
FIG. 11B is a view in an arrow B direction of FIG. 1A.
Figure 10:
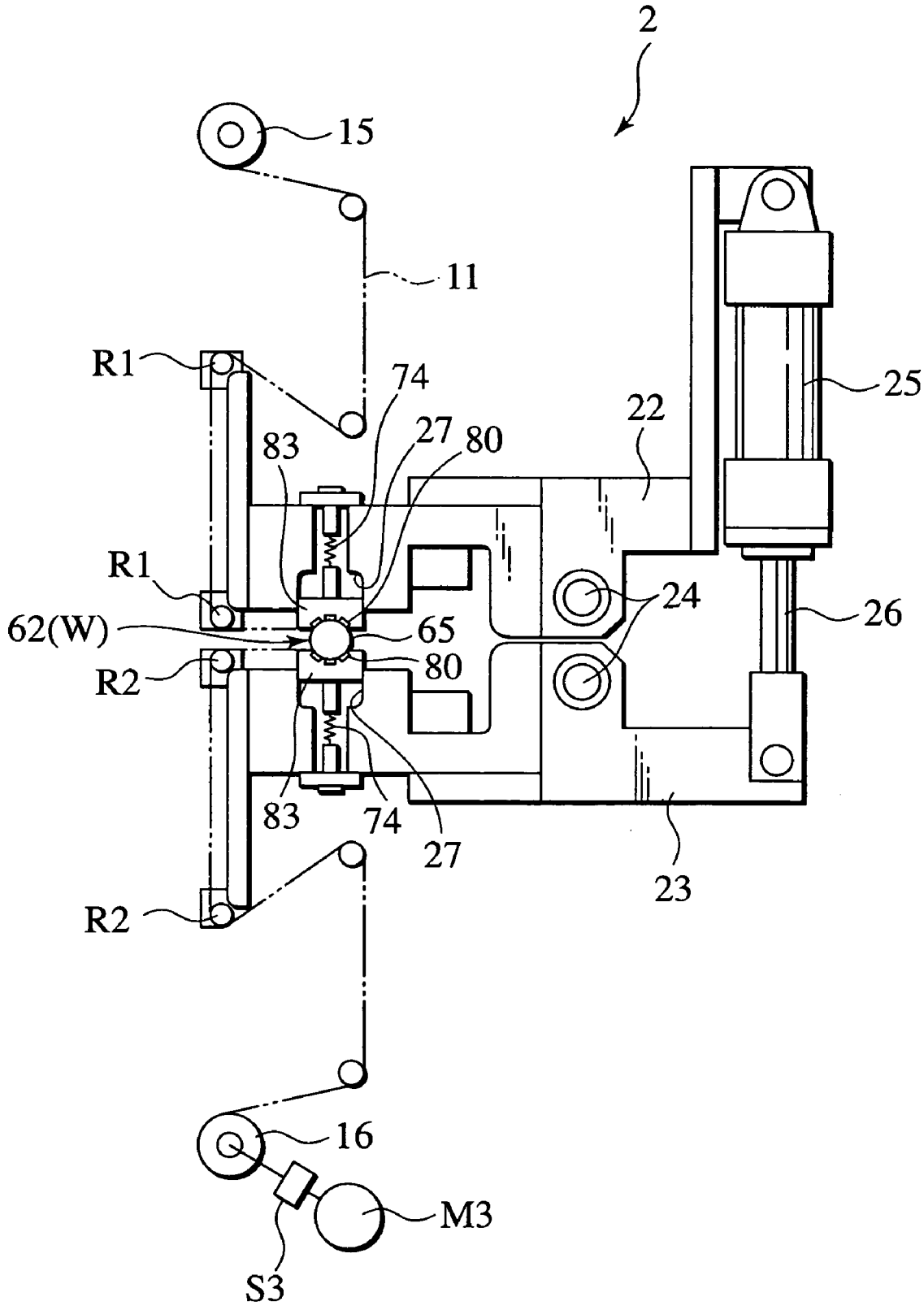
FIG. 10 is a schematic cross-sectional view of a lapping apparatus according to a second embodiment of the present invention, in a closed state of upper and lower arms openably and closably provided in the lapping apparatus.

FIG. 10 shows a closed state of upper and lower arms 22, 23 openably and closably provided in a lapping apparatus 2 according to a second embodiment of the present invention. Further, FIGS. 11A and 11B show shoes 80 and a shoe case 83 to be used in the second embodiment. Note, like reference numerals as used for elements in the first embodiment are used to denote corresponding or identical elements in the second embodiment, and the explanation thereof shall be omitted.

As shown in FIG. 10, the lapping apparatus 2 according to the second embodiment is suitable for lapping the crankshaft 62 as the work W having the pre-machined surfaces 65 formed with open holed portions 66 such as lubricant holes identically to the first embodiment, and includes the lapping films 11 and the shoes 80 for pressing the abrasive-grained surfaces of lapping films 11 to the pre-machined surfaces 65, respectively. Only, this embodiment is different from the first embodiment, concerning the structure itself of each shoe 80, and concerning absence of second shoes 72, shoe driving units 30 and the like.

As shown in FIGS. 11A and 11B, each shoe 80 according to the second embodiment includes first shoe members 81 constituting hard shoes and second shoe members 82 constituting soft shoes. The second shoe members 82 are arranged at sites where the lapping film is pressed to mouth bases 67 of holed portions 66, i.e., at locations where the holed portions 66 pass along. The leftmost shoe in FIG. 11B is constituted of the first shoe member 81 only, including the location where the holed portions 66 pass along.

Each first shoe member 81 is formed of a hard material such as grindstone or steel, so as to constitute a hard shoe. Contrary, each second shoe member 82 is formed of a material such as urethane resin which is softer than the first shoe member 81 and elastically deformable, so as to constitute a soft shoe.

The surface of each second shoe member 82 is protruded to the work W by a slight length (several μm) from the surface of the associated first shoe member 81. The optimum value of the protruded length of the second shoe member 82 is determined based on the hardness of the second shoe member 82 and the shoe pressing force.

Upon clamping the crankshaft 62 in the lapping apparatus 2 including the shoes 80 of such a constitution, both of the first shoe members 81 and second shoe members 82 are applied with reactive elastic forces of work clamping springs 74 and pressed to the pre-machined surfaces 65, respectively.

Moreover, the crankshaft 62 is rotated around its axis by operating the rotational driving unit 40 while applying oscillation to the crankshaft 62 along the axial direction thereof, so that the abrasive-grained surfaces of lapping films 11 are pressed to the pre-machined surfaces 65 by the first shoe members 81 constituting the hard shoes, respectively, thereby lapping the pre-machined surfaces 65 throughout the whole thereof. Further, the abrasive-grained surfaces of the lapping films 11 are pressed to the mouth bases 67 by the second shoe members 82 constituting the soft shoes, thereby forming the rounded portions 68 at the mouth-base edges 67*a*, respectively.

During the lapping, the crankshaft 62 is forwardly rotated by a predetermined number of revolutions (such as 5 revolutions), and thereafter rearwardly rotated by the same number of revolutions. Changing the rotating direction maintains the performance of the lapping films 11, and causes the entire circumferences of the mouth bases 67 to be uniformly machined.

Also in the second embodiment, the machining for the entire circumferences of the pre-machined surfaces 65 by the first shoe members 81, i.e., by the hard shoes and the machining for the mouth bases 67 by the second shoe members 82, i.e., by the soft shoes are conducted by the single set of lapping apparatus, thereby enabling to improve the machining efficiency and to shorten the time required for the machining, in this way. Further, the number of equipments is not increased, thereby also allowing to restrict an increase of equipment cost and machining cost.

It is additionally possible to replace shoes in an existing lapping apparatus by the shoes 80 of the second embodiment, thereby enabling to further restrict an increase of equipment cost, machining cost and the like as compared with the first embodiment.

Moreover, since the leftmost shoe 80 is constituted of the hard shoe such that the machining by the hard shoes for improving the shape accuracy (such as circularity and straightness) of each pre-machined surface 65 and the machining by the associated soft shoes for forming the rounded portion 68 at the mouth-base edge 67*a* are conducted in the same process, those regions of the pre-machined surface 65 which are once exerted with the machining by the soft shoes are subjected to the function for correcting the work shape based on the leftmost hard shoe. Thus, there is no risk that the shape accuracy of each pre-machined surface 65 is deteriorated due to the machining by the associated soft shoes.

Note, the second embodiment can be effectively applied to a work W the rounding amounts of the mouth-base edges 67*a* of which are smaller than those in the first embodiment.

Modified Embodiment

The pre-machined surfaces 65 of the work W are never delimited to the pin portions 63, journal portions 64 or the like of the crankshaft 62, and can be applied to other various works W insofar as having a pre-machined surface 65 formed with an open holed portion 66.

Although the first embodiment has been exemplified in the configuration using the eccentric cams 31, motors M4 and the like as the shoe driving units 30, respectively, the first embodiment can be appropriately modified without limited thereto. For example, it is possible to drive the second shoes 72 to the operative positions or inoperative positions thereof, by actuators such as servomotors or fluid pressure cylinders to be operated by air pressure.

Further, although there has been shown a situation where each second shoe 72 is constituted of a soft shoe, it is possible to obtain the same effect even by a configuration in which the second shoe 72 is constituted of the same hard shoe as the first shoe 71 while the pressing force of the second shoe 72 is made weaker than that of the first shoe 71. The shoe pressing forces can be then adjusted, by adjusting the fluid pressure such as oil pressure or air pressure, or by adjusting the reactive elastic forces of springs, for example.

Moreover, the soft shoes 72 may be oscillated in the axial direction of the work.

While the leftmost shoe 80 in FIG. 11 has been constituted of the first shoe member 81 (hard shoe) only, such a constitution is not a requirement indispensable to the present invention. For example, it is possible to arrange a second shoe member 82 at a location of the leftmost shoe 80 where the holed portions 66 pass along, in a situation that the deterioration of shape accuracy of the pre-machined surface 65 by the second shoe members 82 (soft shoes) can be limited within a predetermined tolerance.

Third Embodiment

There will be explained hereinafter a third embodiment of the present invention with reference to the drawings. Like reference numerals as used for components in the first embodiment are used to denote corresponding or identical components in the third embodiment, and the explanation thereof shall be omitted.

Figure 12:
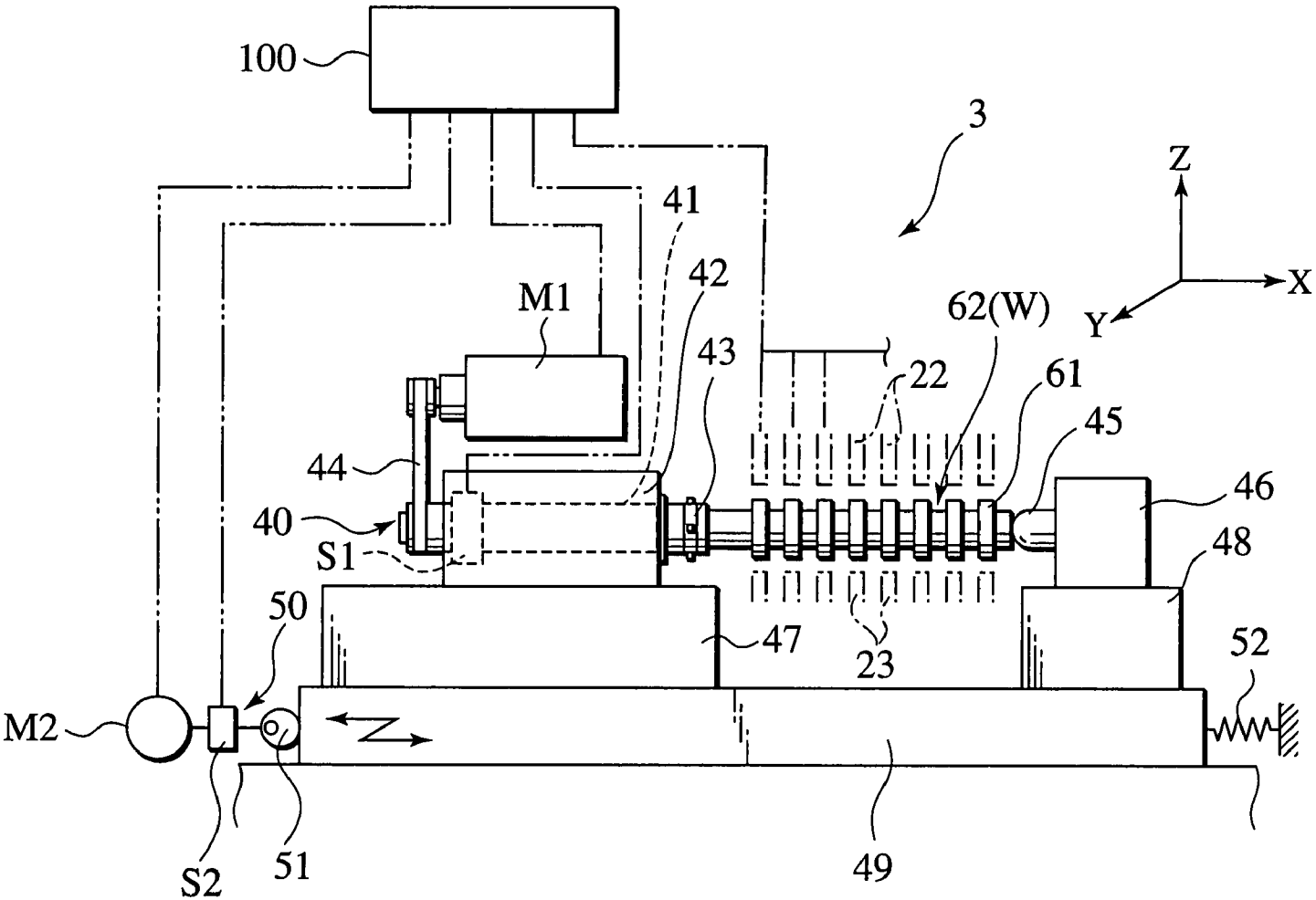
FIG. 12 is a schematic view of a lapping apparatus according to a third embodiment of the present invention.
Figure 13:
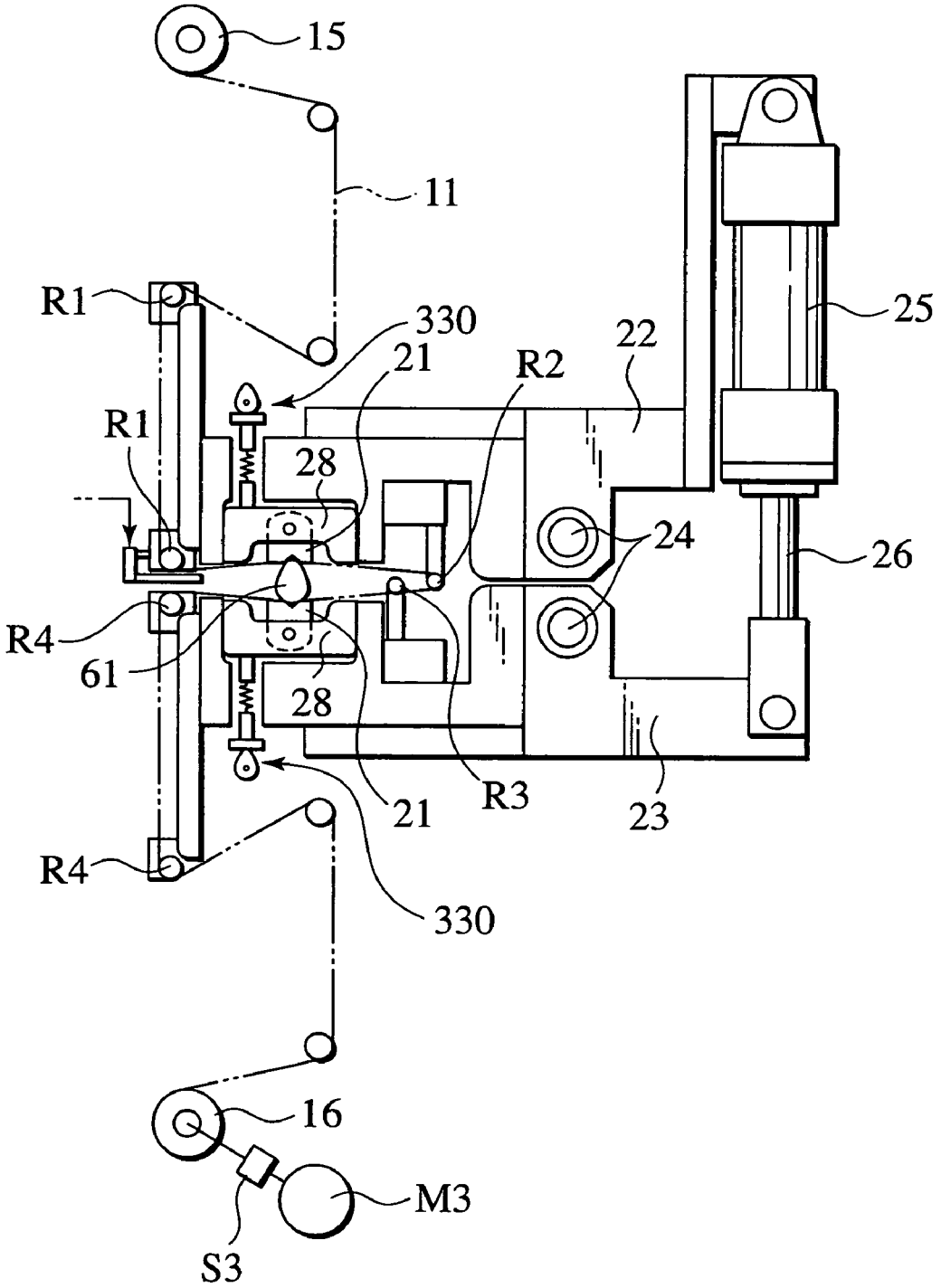
FIG. 13 is a schematic cross-sectional view showing a closed state of upper and lower arms openably and closably provided in the lapping apparatus.
Figure 14:
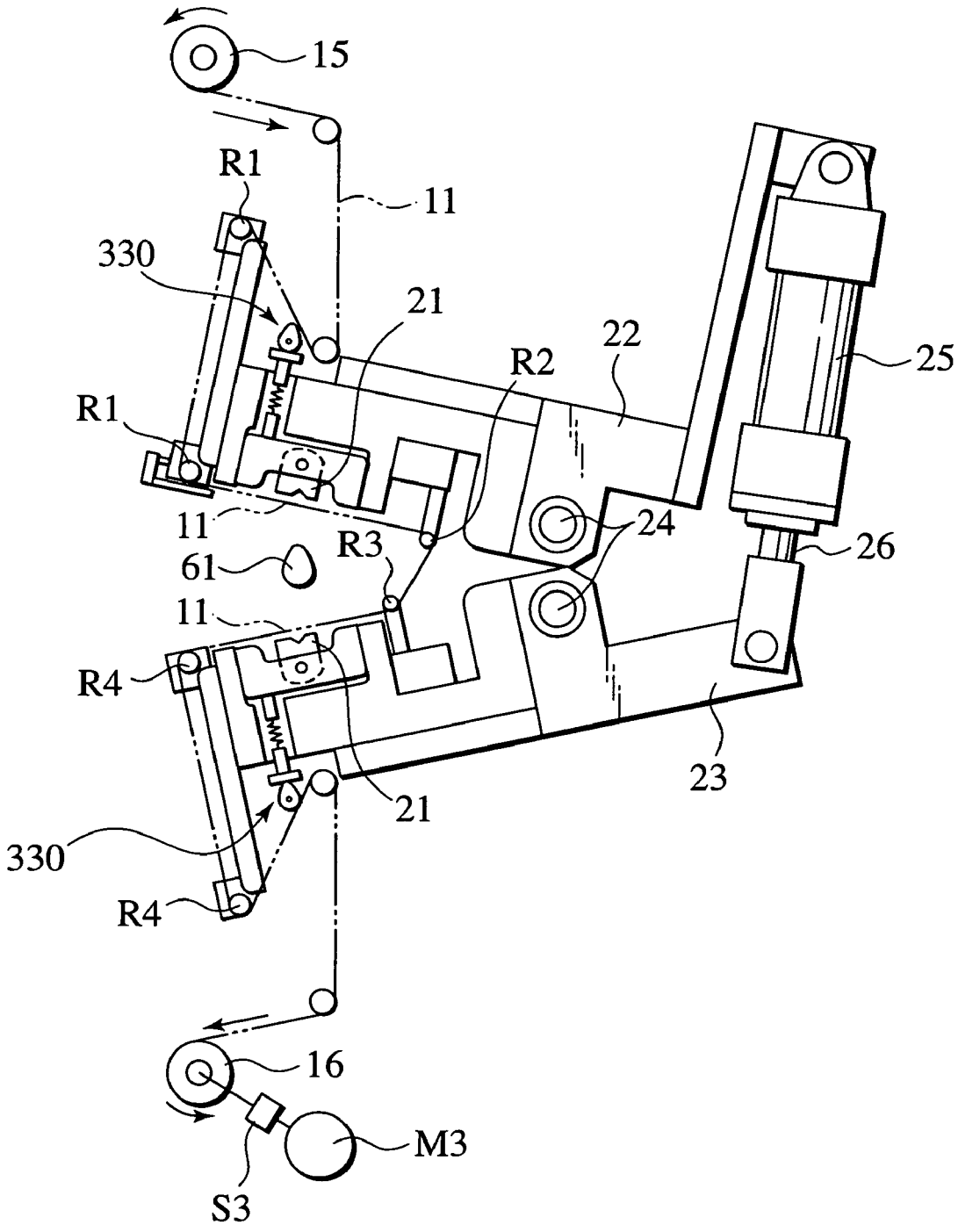
FIG. 14 is a schematic cross-sectional view showing an opened state of the upper and lower arms.
Figure 15:
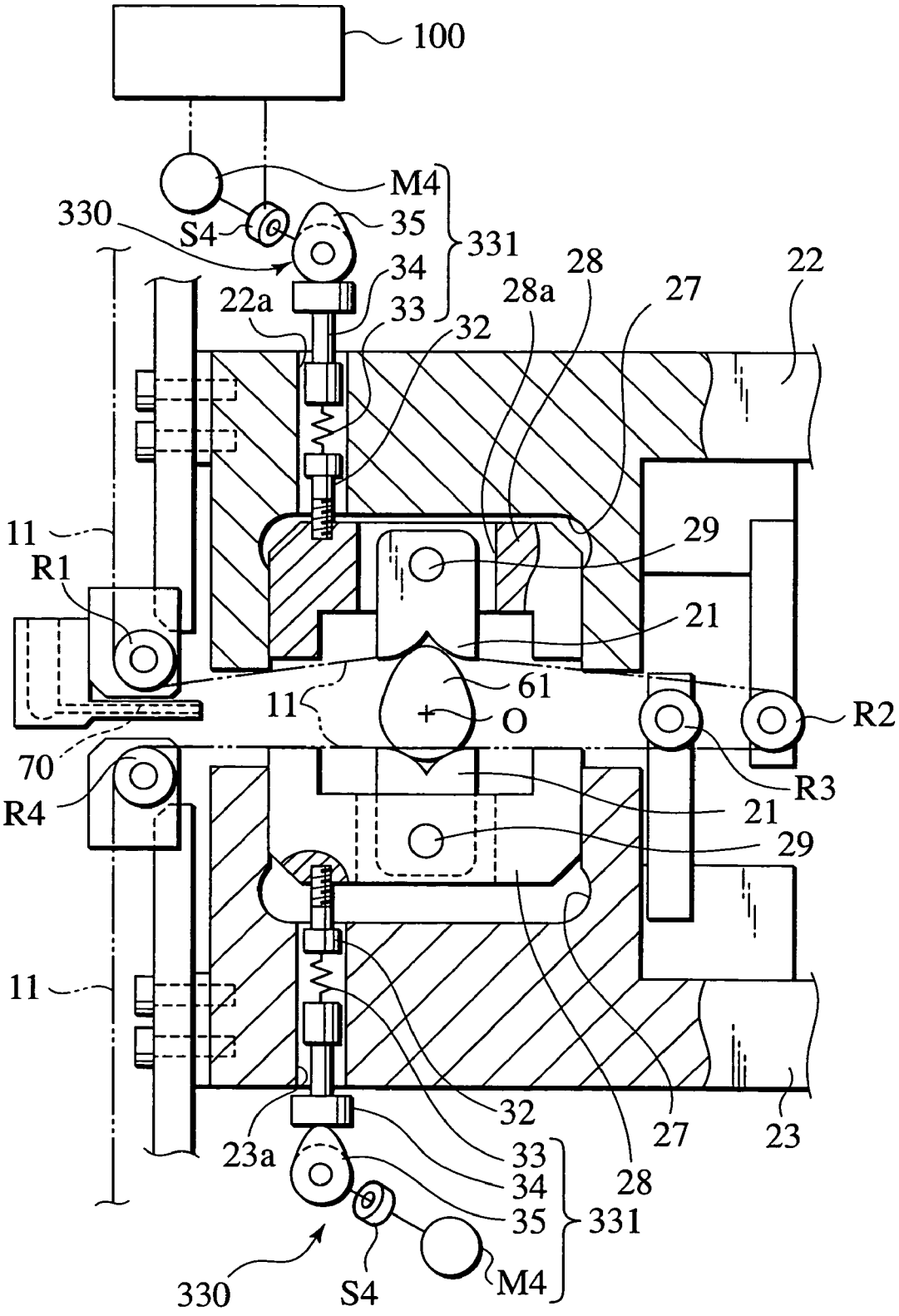
FIG. 15 is a cross-sectional view of essential parts of the lapping apparatus.
Figure 16:
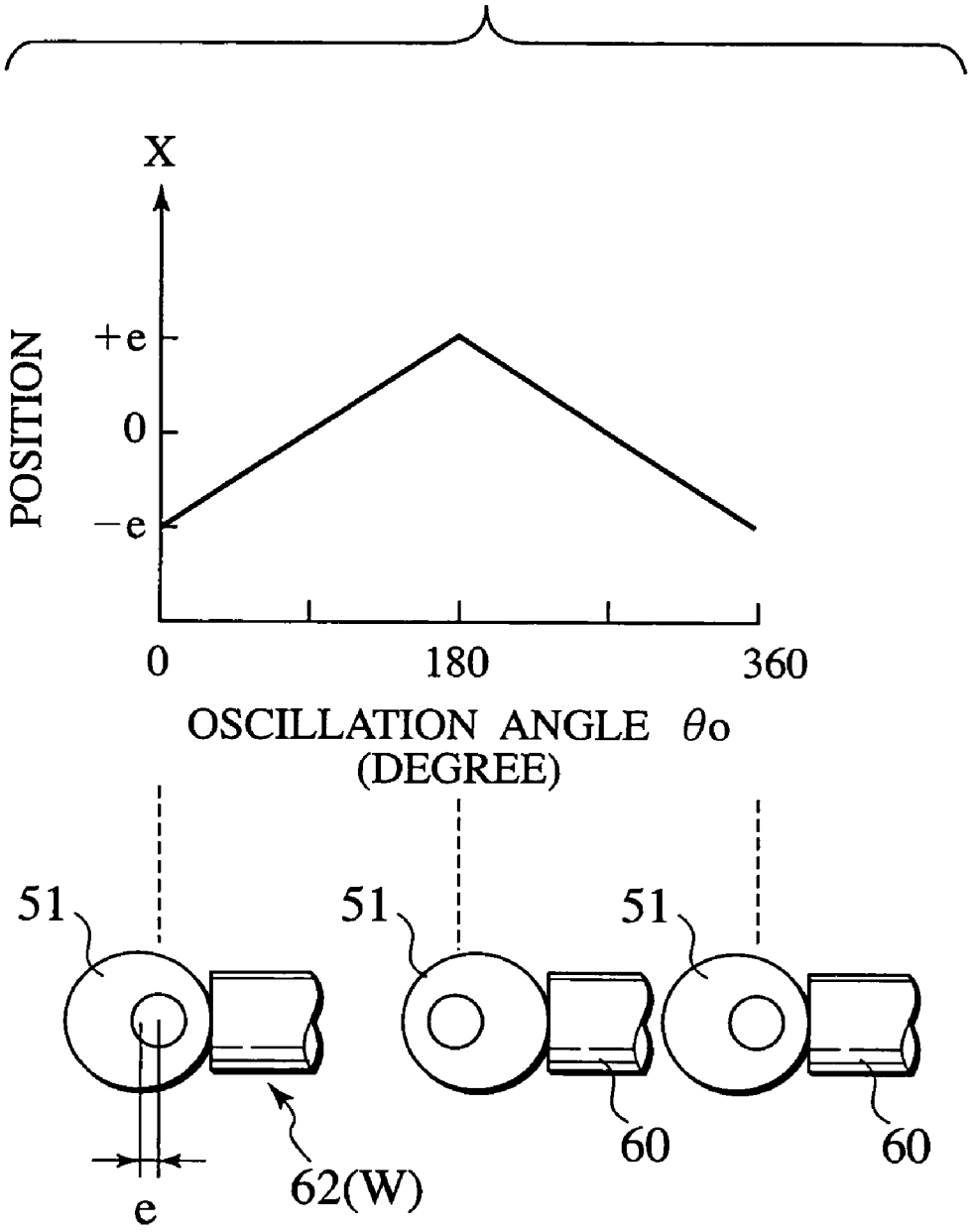
FIG. 16 is an explanatory diagram of camshaft position accompanying to oscillations.
Figure 17:
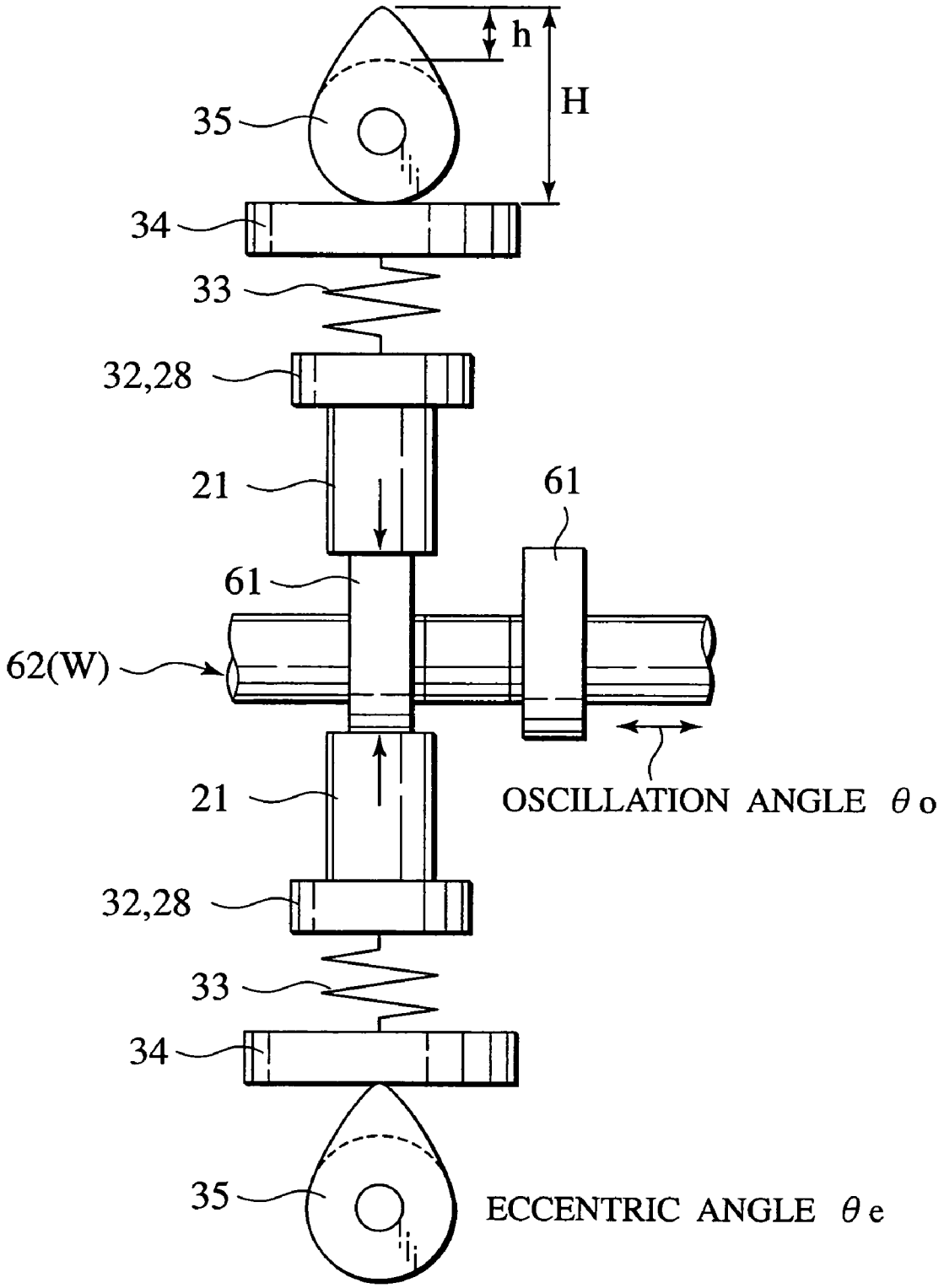
FIG. 17 is a conceptional view of a constitution equivalent to a shoe pressing unit.
Figure 18:
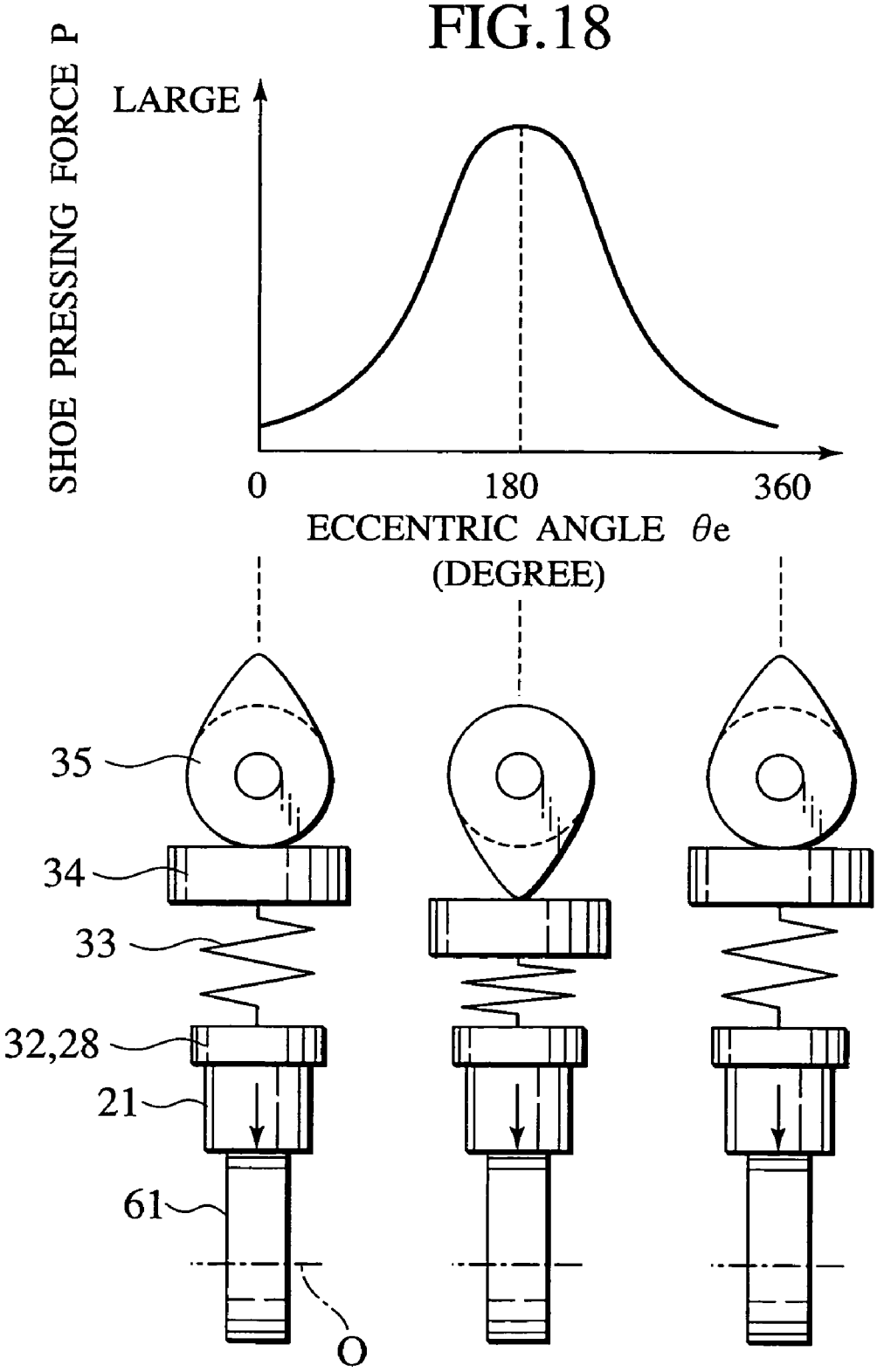
FIG. 18 is an explanatory diagram of a transition of a shoe pressing force.
Figure 19A:
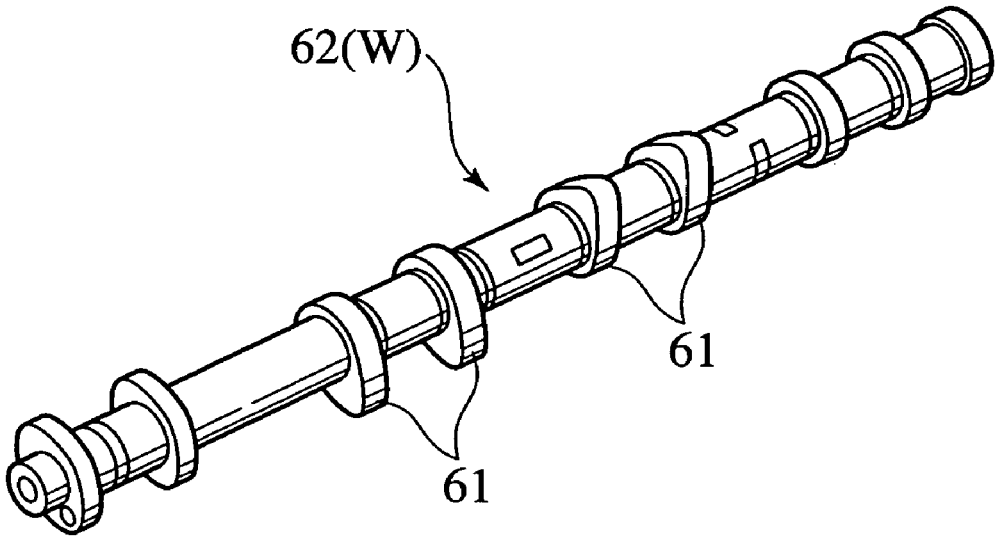
FIG. 19A is a perspective view of an exemplary camshaft as a work to be lapped.
Figure 19B:
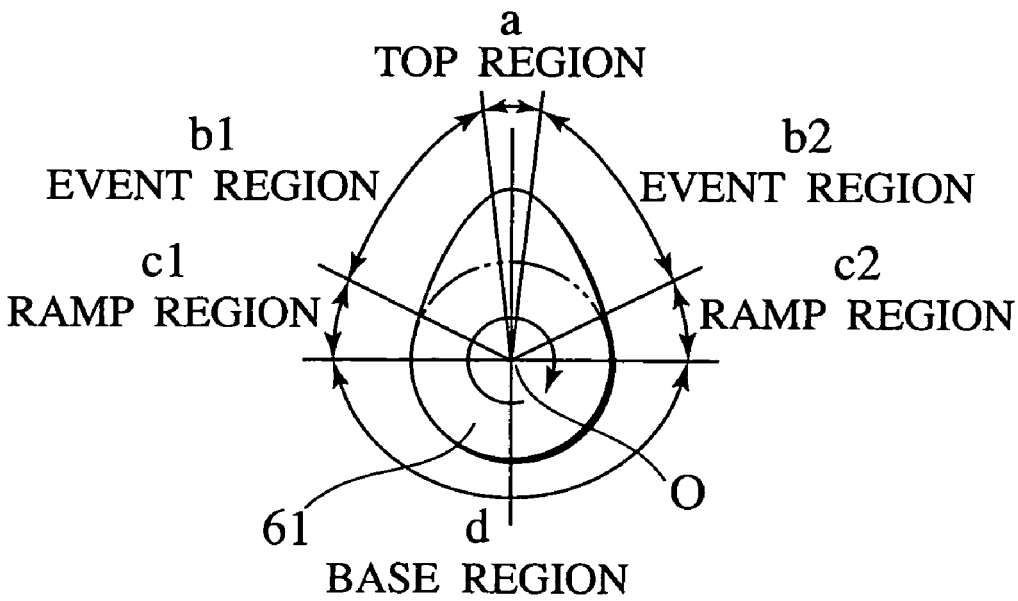
FIG. 19B is an explanatory view of respective regions of a cam-lobe portion of the camshaft.

FIG. 12 shows a lapping apparatus 3 according to the third embodiment of the present invention. FIG. 13 shows a closed state of upper and lower arms 22, 23 openably and closably provided in the lapping apparatus 3. FIG. 14 shows an opened state of the upper and lower arms 22, 23. FIG. 15 shows essential parts of the lapping apparatus 3. Further, FIG. 16 shows camshaft position accompanying to oscillations. FIG. 17 shows a constitution equivalent to a shoe pressing unit 330 (corresponding to a shoe driving unit). FIG. 18 shows a transition of a shoe pressing force P. Moreover, FIG. 19A shows an exemplary camshaft 60 as a work to be lapped, and FIG. 19B shows respective regions of a cam-lobe portion 61 of the camshaft 60. As an expediency of explanation, the axial direction of the camshaft 60 (i.e., the right-and-left direction in FIG. 12) is defined as an X direction, the horizontal direction perpendicular to the X direction (i.e., the direction perpendicular to the drawing plane of FIG. 12) as a Y direction, and the vertical direction perpendicular to the X direction (i.e., the up-and-down direction in FIG. 12) as a Z direction.

Generally, with reference to FIGS. 12 through 15, the lapping apparatus 3 of this embodiment includes: lapping films 11 each comprising an inextensible and deformable thin substrate having one surface provided with abrasive grains; shoes 21 arranged at the back surface sides of the lapping films 11, respectively; shoe pressing units 330 for pressing the shoes 21 in order to pressing the abrasive-grained surfaces of the lapping films 11 toward the work W, respectively; a rotational driving unit 40 for rotationally driving the work W; and an oscillation unit 50 for applying oscillation in the axial direction of the work W, to at least one of the work W and lapping films 11; such that the rotating work W is lapped by pressing the lapping films 11 thereto. The shoe pressing units 330 include adjusting units 331 for adjusting the shoe pressing forces P, respectively (see FIG. 15). The lapping apparatus 3 of this embodiment is preferably utilized to lap the work W having the pre-machined surfaces in cross-sectionally non-circular arcuate shapes. This type of works W include the camshaft 60 shown in FIG. 19A, and outer peripheral surfaces of cam-lobe portions 61 of this camshaft 60 exemplarily establish the pre-machined surfaces to be lapped. Multiple pairs of coupled upper and lower arms 22, 23 are provided correspondingly to the positions of cam-lobe portions 61 (see FIG. 12).

Note, the term "cross-sectionally non-circular arcuate shape" used herein means an arcuate or elliptic shape in which a radius from a center of rotation of the shape to a part of an outer periphery of the shape is made different from other radii from the center of rotation to the other parts of the outer periphery of the shape, and it is to be understood that this term embraces an egg-like shape such as the illustrated cam-lobe portion 61 of course, as well as such a shape having a circular outer periphery in which the center of rotation of the shape is offset from the center of the circle.

There will be explained hereinafter the lapping apparatus 3 in detail.

Referring to FIG. 12, the camshaft 60 is machined as the work W in the lapping apparatus 3, instead of the crankshaft 62.

As shown in FIG. 16, the position of the camshaft 60 in the X direction by the oscillation is changed correspondingly to the rotational position of the eccentric rotor 51. Namely, when it is assumed that the initial position (oscillation angle $\theta c=0°$) of the eccentric rotor 51 is a position where the camshaft 60 is displaced from the neutral position of the camshaft 60 itself in the −X direction by an eccentricity amount "e" of the eccentric rotor 51, the camshaft position is to be displaced in the +X direction by the eccentricity amount "e" relative to the neutral position when the eccentric rotor 51 has been rotated from the initial position and the oscillation angle $\theta c$ becomes 180°. When the oscillation angle $\theta c$ becomes 360° by further rotation of the eccentric rotor 51, the camshaft position is returned to its initial position corresponding to the initial position of the eccentric rotor 51. To detect such a positional change of the camshaft 60 in the X direction accompanying to the oscillation, the shaft of the eccentric rotor 51 is attached with a rotary encoder S2 for detecting the rotational position of the eccentric rotor 51 (see FIG. 12).

Referring to FIG. 13 and FIG. 14, each lapping film 11 is drawn out of an associated feeding reel 15 while being exemplarily guided by a pair of first guiding rollers R1 disposed at a tip end of the associated upper arm 22, a second guiding roller R2 attached to an inside position of the upper arm 22, a third guiding roller R3 attached to an inside position of the lower arm 23, and a pair of fourth guiding rollers R4 disposed at the tip end of the lower arm 23, and then wound up by an associated wind-up reel 16.

Pivotal movements of the upper and lower arms 22, 23 are conducted consonantly with the lapping films 11, such that the closing pivotal movements cause the associated shoes 21 to abut onto the applicable cam-lobe portion 61 via lapping film 11, and the opening pivotal movements release the abutment of the shoes 21 on the cam-lobe portion 61.

While the shoes 21 are classified into convex shoes and concave shoes, the shoes 21 in the illustrated embodiment are concave ones each having a concave tip end portion and each abutting on the pre-machined surface of the associated cam-lobe portion 61 at multiple locations (such as two locations) via film 11. While the tip end portion of each concave shoe 21 is concave, the abutting surfaces themselves of the shoe onto the work W are formed into cross-sectionally convex arcuate surfaces, respectively. Although via films 11, each concave shoe 21 contacts with the pre-machined surface of the cam-lobe portion 61, in a line contact manner at two locations. Each cam-lobe portion 61 are supported at four points by the upper and lower shoes 21, thereby enabling to stably rotate the cam-lobe portion 61. Note, also in this embodiment, the indirect abutment of the shoe 21 on the outer peripheral surface of the work W via film 11 is abbreviated to "contact", and the area through which each shoe 21 abuts on the outer peripheral surface of the work W via lapping film 11 is abbreviated to "contact surface area".

As also shown in FIG. 15, shoe cases 28 holding the shoes 21 therein are housed in the concaves 27 formed at the tip end portions of the upper and lower arms 22, 23, respectively, in a manner capable of advancing and retracting relative to the work W. Each shoe case 28 is moved, while being guided along an inner surface of the associated concave 27 by an outer surface of the shoe case 28. The shoes 21 are held in the neck-swingable member within hollows 28*a* provided at the shoe cases 28, via swing pins 29, respectively. The upper and lower swing pins 29 are located on a line passing through an axis O of the camshaft 60, such that the shoe pressing forces P efficiently act on the film 11. Reference numeral 70 in FIG. 15 designates a nozzle for supplying a coolant.

The shoe pressing units 330 are arranged at the tip end portions of the upper and lower arms 22, 23, respectively. As conceptually shown in FIG. 17, each shoe pressing unit 330 includes: a coupling rod 32 having a tip end coupled to the associated shoe case 28; a work clamping spring 33 comprising a compression coil spring; an pressing rod 34 for elastically deforming the work clamping spring 33 between the coupling rod 32 and the pressing rod 34 itself; an eccentric rotor 35 abutted on a head portion of the pressing rod 34; and an pressing motor M4 for rotationally driving the eccentric rotor 35. The coupling rod 32 and pressing rod 34 are slidably housed within a through-hole 22*a*/23*a* formed in the associated arm 22/23. Pressing the shoe cases 28 to the associated cam-lobe portion 61 causes the shoes 21 held in the shoe cases 28, and thus the abrasive-grained surfaces of the associated lapping film 11 to press the cam-lobe portion 61. Each eccentric rotor 35 has a cam lift "h" obtained by subtracting a base circle diameter from an overall height "H" of the cam, and this cam lift "h" corresponds to the distance through which the pressing rod 34 can be maximally moved. Each adjusting unit 331 for adjusting the shoe pressing force P is constituted of the associated work clamping spring 33, pressing rod 34, eccentric rotor 35 and pressing motor M4.

As shown in FIG. 18, the shoe pressing force P is changed correspondingly to the rotational position of the eccentric rotor 35. Namely, when it is assumed that the initial position (eccentric angle θe=0°) of the eccentric rotor 35 is a position where the base circle of the eccentric rotor is abutted on the head portion of the associated pressing rod 34, the pressing rod 34 is moved by the cam lift "h" when the eccentric rotor 35 is rotated from this initial position and the eccentric angle θe becomes 180°, such that the work clamping spring 33 is further elastically and compressedly deformed, resulting in the maximized shoe pressing force P. When the eccentric angle θe becomes 360° by a further rotation of the eccentric rotor 35, the pressing rod 34 is returned to its initial position, and also the shoe pressing force P is returned to the same pressing force as the initial position. To detect such a transition of the shoe pressing force P, the shaft of each eccentric rotor 35 is attached with the rotary encoder S4 for detecting the rotational position of the eccentric rotor 35 (see FIG. 15).

As shown in FIG. 19B, each cam-lobe portion 61 includes multiple regions comprising: a base region "d" defining a base circle; a top region "a" defining the cam lift; event regions "b1, b2" continued to both sides of the top region "a", for starting to open and close a valve of an engine, respectively; and ramp regions "c1, c2" approaching the event regions "b1, b2" from the base region "d", respectively.

Figure 20A:
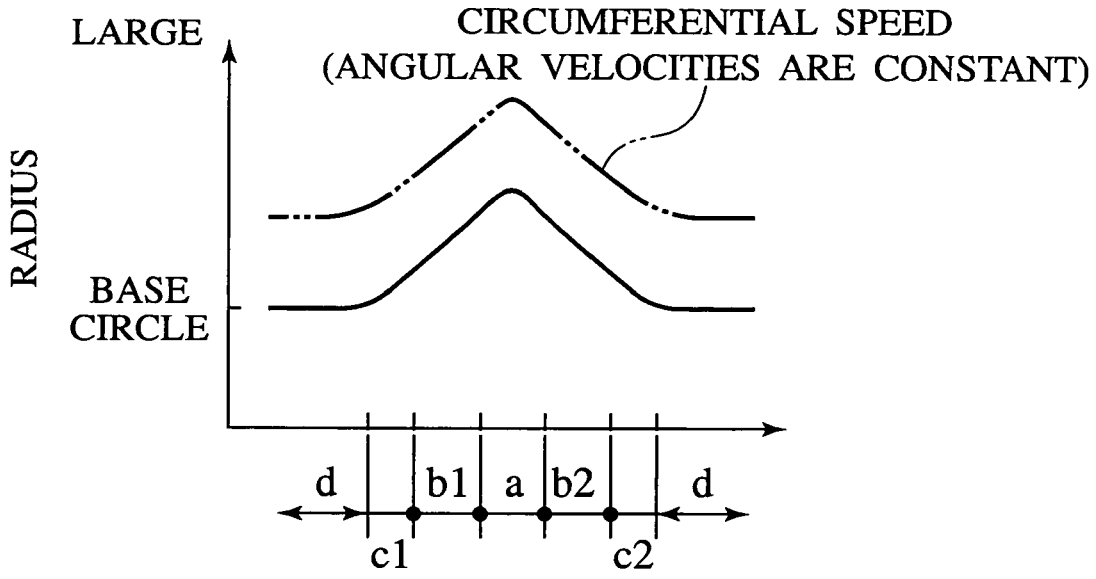
FIG. 20A is a diagram representing a radius from an axis (center of rotation) of the cam-lobe portion to a pre-machined surface thereof.
Figure 20B:
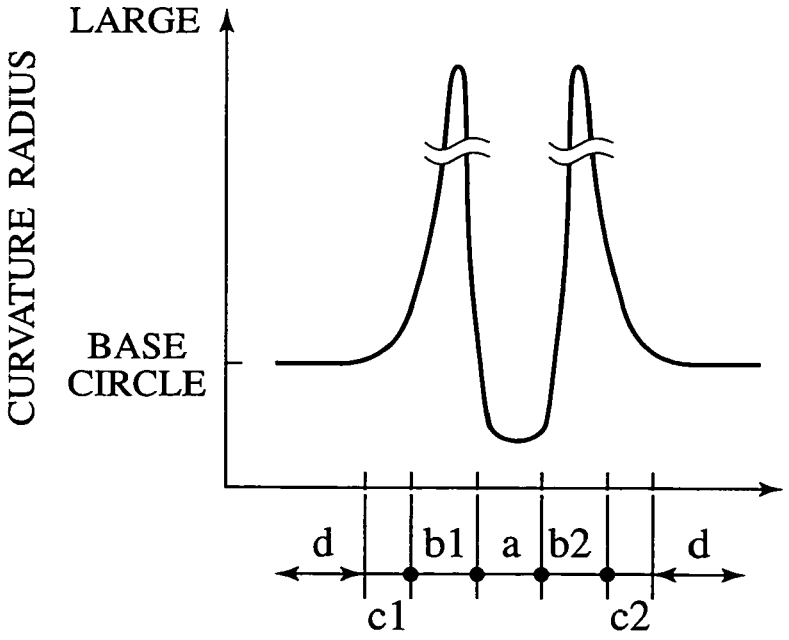
FIG. 20B is a diagram representing a curvature radius at the pre-machined surface of the cam-lobe portion.

FIG. 20A shows a radius from an axis O (center of rotation) of the cam-lobe portion 61 to a pre-machined surface thereof, and FIG. 20B shows a curvature radius at the pre-machined surface of the cam-lobe portion 61.

As shown in FIG. 20A, when the pre-machined surface of the cam-lobe portion 61 is in a cross-sectionally non-circular shape, the radius from the axis O (center of rotation) of the cam-lobe portion 61 to the pre-machined surface is changed region by region, such that the radius is increased from the terminating end of the base region "d" toward the top region "a". Further, as shown in FIG. 20B, the base region "d" has a constant curvature radius, while the event regions "b1, b2" have extremely larger curvature radii because these regions are substantially straight, and the top region "a" has a relatively small curvature radius.

If the work rotational speed Vw is made constant in case of lapping each cam-lobe portion 61 having such a shape, the contact time per unit circumferential length of the outer peripheral surface as the pre-machined surface of the cam-lobe portion with the film 11 becomes different region by region, as described above. Further, in the configuration where each neck-swingable concave shoe 21 is pressed to the associated cam-lobe portion 61, since the concave shoe 21 is neck swung and largely inclined while the concave shoe 21 contacts with the event region "b1"/"b2", that component force of the applied shoe pressing force P, which acts in the normal direction of the contacting point between the concave shoe and the event region, becomes relatively small. Further, since the event regions "b1, b2" have extremely larger curvature radii, respectively, the contact surface areas of them relative to the shoe 21 become larger as compared with the other regions. Thus, the contact surface pressure of the film 11 is different region by region in such a situation, and particularly, the contact surface pressure is considerably lowered at the event regions "b1, b2". This leads to an uneven machined amount of the pre-machined surface per unit circumferential length of the cam-lobe portion 61, thereby resultingly causing a possibility of increased surface roughness of the pre-machined surface, particularly of the event regions "b1, b2".

In view of the above, the machined amount per unit circumferential length at the pre-machined surface of each cam-lobe portion 61 is uniformalized in the lapping apparatus 3 of this embodiment, by detecting the rotational position of the cam-lobe portion 61 by the associated rotary encoder S1 in order to variably control at least one of the shoe pressing force P, work rotational speed Vw and oscillation speed Vo, correspondingly to the rotational position of the cam-lobe portion 61 during machining.

Figure 21:
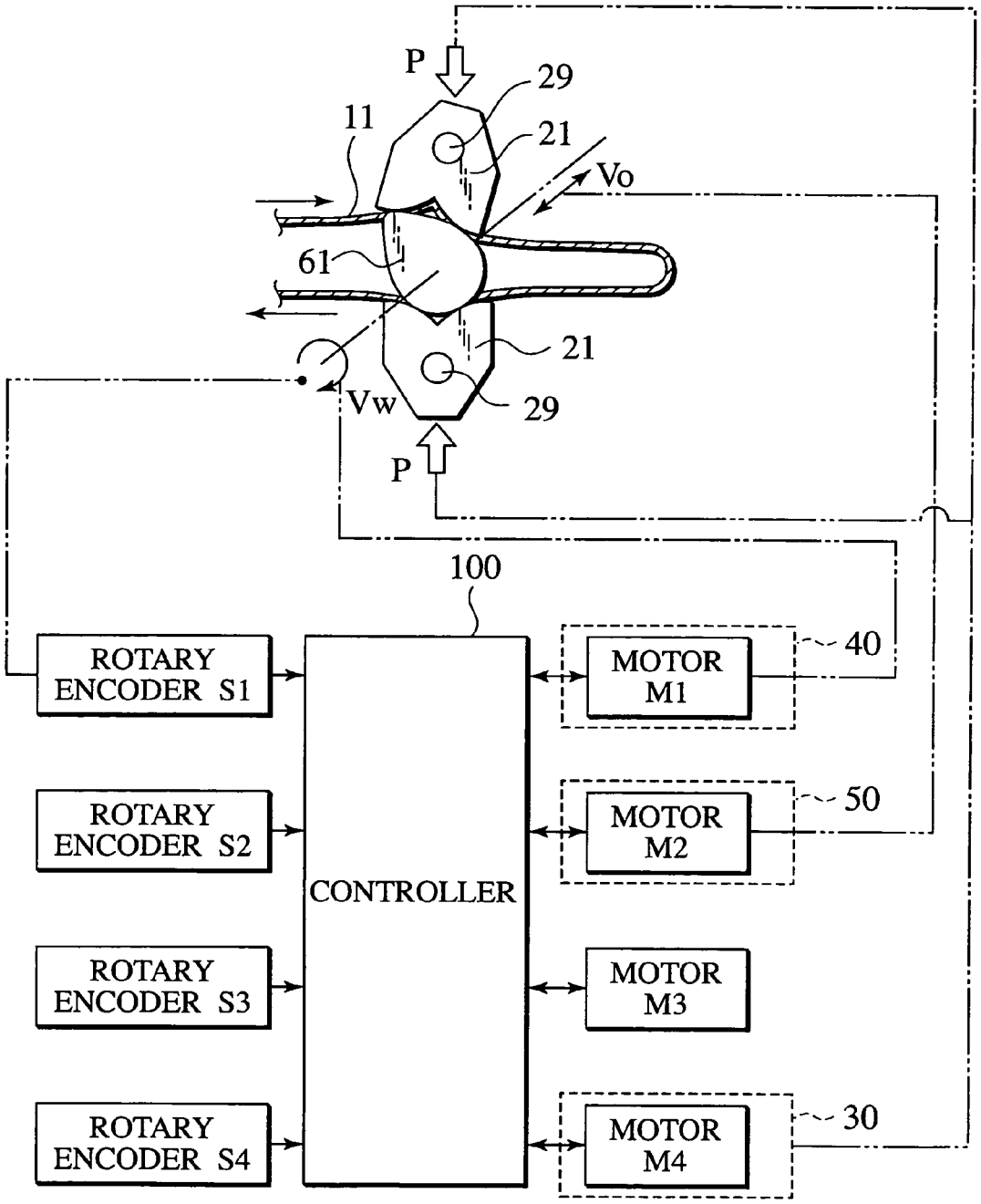
FIG. 21 is a schematic block diagram of a control system of this lapping apparatus according to the present invention.
Figure 22A:
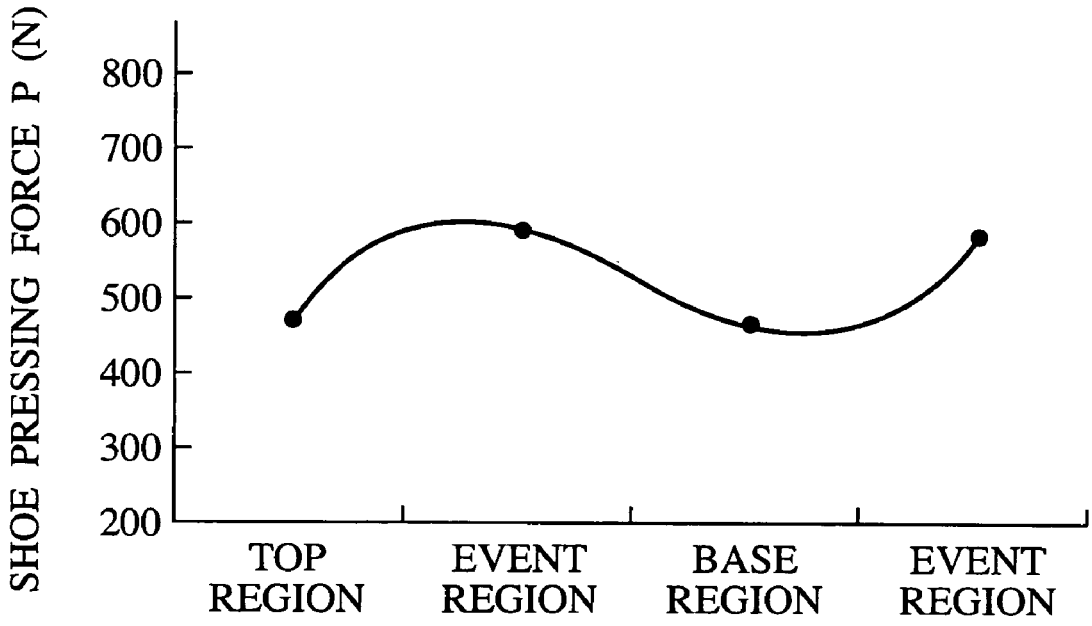
FIG. 22A is a diagram representing an example of variable control for controlling a shoe pressing force correspondingly to a rotational position of a cam-lobe portion during machining.

The above control will be explained with reference to FIG. 21 through FIG. 23. FIG. 21 shows a control system of the lapping apparatus 3 according to the present invention. FIG. 22A shows an example of variable control for controlling the shoe pressing force P correspondingly to a rotational position of the cam-lobe portion 61 during machining, and FIG. 22B explains a contact surface pressure at respective regions of the cam-lobe portion 61. FIG. 23A shows an example of variable control for controlling the work rotational speed Vw correspondingly to a rotational position of the cam-lobe portion 61 during machining, and FIG. 23B shows an example of variable control for controlling the oscillation speed Vo correspondingly to a rotational position of the cam-lobe portion 61 during machining.

As an expediency of explanation, the erected position of each cam-lobe portion 61 where the top region "a" and base region "d" thereof are positioned at the top and bottom, respectively, shown in FIG. 15 is defined as an initial position of the cam-lobe portion 61, and the inverted position of the cam-lobe portion 61 rotated from the initial position by 180° where the top region "a" and base region "d" are positioned at the bottom and top, respectively, is defined as a reverse position of the cam-lobe portion 61.

Referring to FIG. 21, the rotary encoders S1, S2, S3, S4 are connected to the controller 100 (corresponding to a controlling unit) such as mainly comprising a CPU and a memory, and the controller 100 is inputted with detecting signals concerning the rotational positions of the cam-lobe portions 61, the rotational positions of the eccentric rotors 35 for varying the shoe pressing forces P, and the rotational position of the eccentric rotor 51 for applying the oscillation during machining. The controller 100 is also inputted with detecting signals concerning the rotational speed of the main-shaft-aimed motor M1 for determining the work rotational speed Vw, and the rotational speed of the oscillation motor M2 for determining the oscillation speed Vo. The controller 100 decides as to which region of each cam-lobe portion 61 is being machined, based on the signal concerning the rotational position of this cam-lobe portion 61 from the rotary encoder S1. Further, the controller 100 variably controls at least one of the shoe pressing forces P, work rotational speed Vw and oscillation speed Vo, correspondingly to the regions which are being machined.

The control for varying the shoe pressing forces P is as follows. As shown in FIG. 22A, in a manner that the shoe pressing forces P upon machining the event regions "b1, b2"

of each cam-lobe portion 61 become larger than the shoe pressing forces P upon machining other regions, the controller 100 controls the operations of the associated adjusting units 331 such as including the associated eccentric rotors 35 and pressing motors M4.

Concretely, the controller 100 outputs a controlling signal to the applicable pressing motor M4 so as to control the rotation of the pressing motor M4, such that the eccentric angle θe of the associated eccentric rotor 35 becomes 0° when the associated rotating cam-lobe portion 61 has reached its initial position, that the eccentric angle θe becomes 180° while the associated shoe 21 contacts with the event region "b1"/"b2" by the rotation of the cam-lobe portion 61, and that the eccentric angle θe becomes 360° when the cam-lobe portion 61 has further rotated and reached its reverse position. Each shoe pressing force P becomes the maximum when the associated eccentric angle θe becomes 180° (see FIG. 18), so that the shoe pressing force P upon machining the event region "b1"/"b2" of the associated cam-lobe portion 61 becomes larger than the shoe pressing force P upon machining the other regions.

Figure 22B:
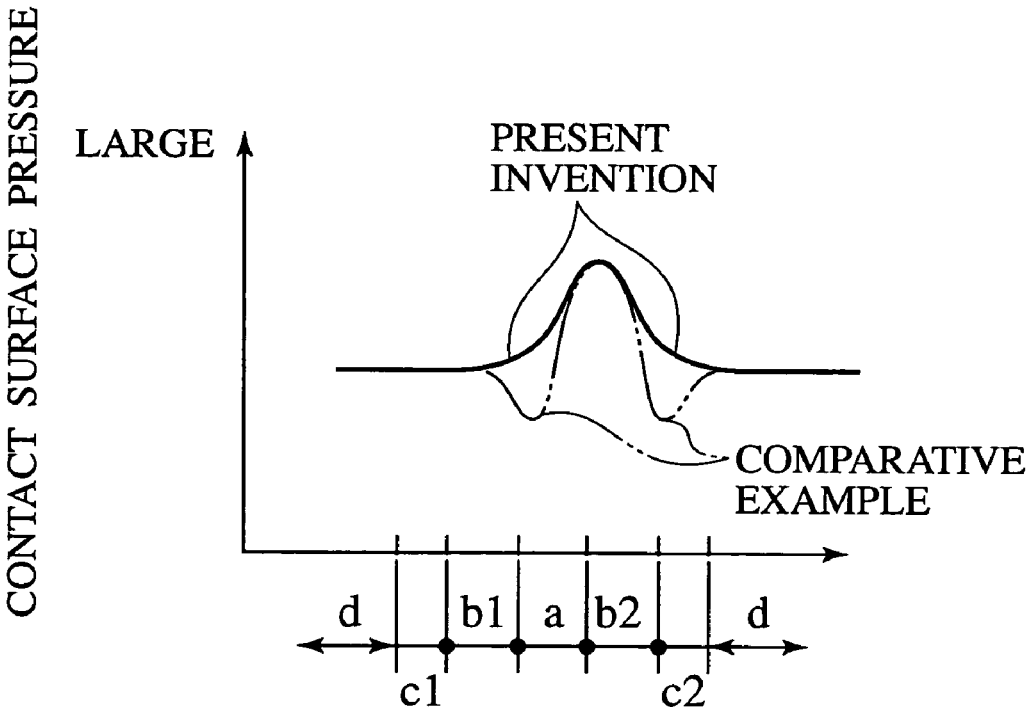
FIG. 22B is a diagram representing a contact surface pressure at respective regions of the cam-lobe portion.
Figure 23A:
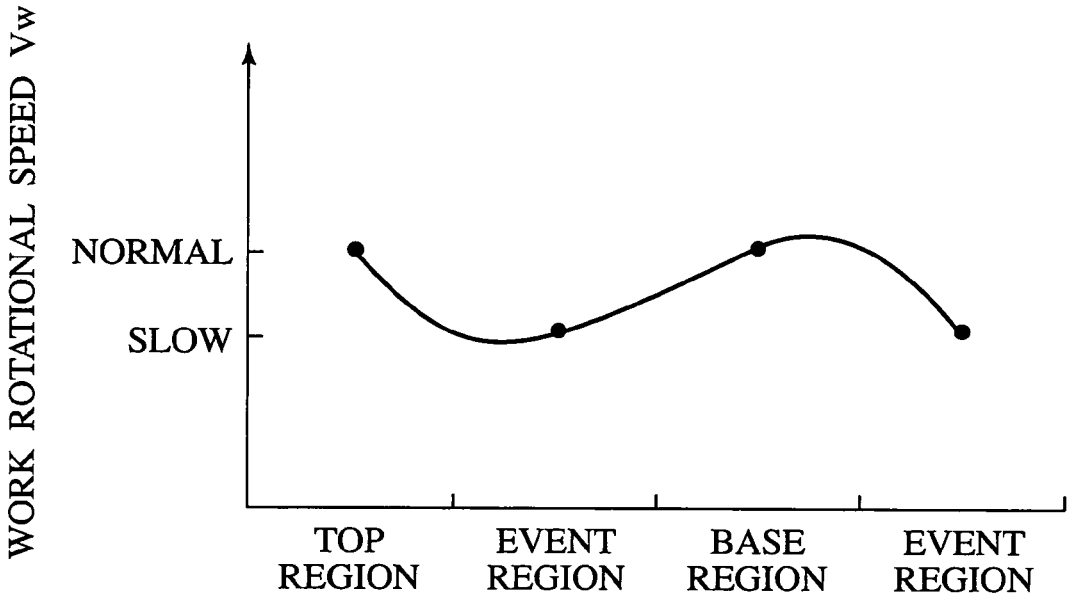
FIG. 23A is a diagram representing an example of variable control for controlling a work rotational speed correspondingly to a rotational position of a cam-lobe portion during machining.
Figure 23B:
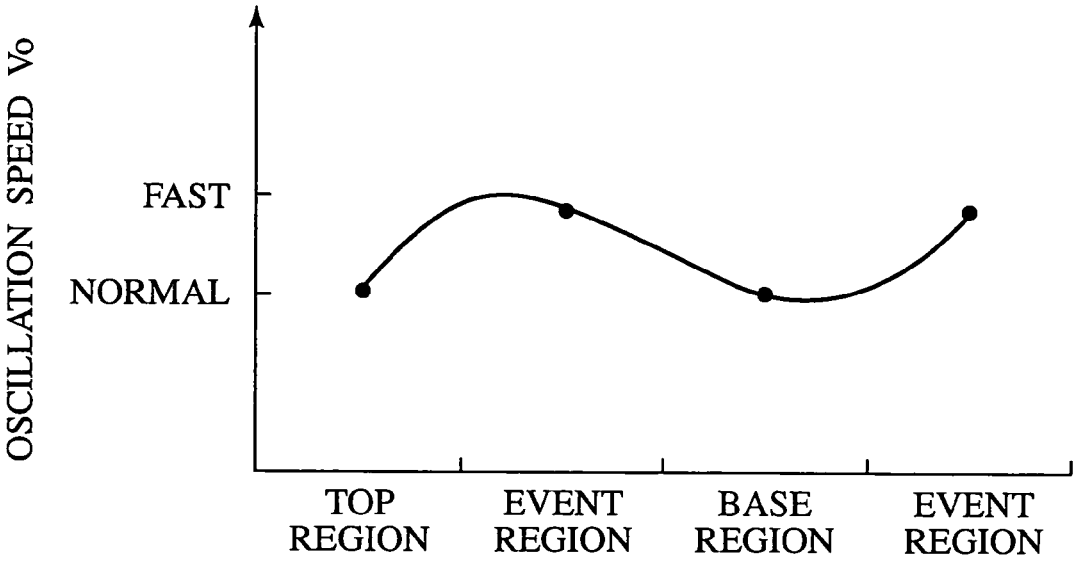
FIG. 23B is a diagram representing an example of variable control for controlling an oscillation speed correspondingly to a rotational position of a cam-lobe portion during machining.

As shown in FIG. 22B by a two-dot chain line, the contact surface pressure at the event regions "b1, b2" is considerably lowered in case of a comparative example in which the shoe pressing force P is kept constant during lapping. Contrary, controlling the shoe pressing force P in the above manner increases the contact surface pressure at the event regions "b1, b2" as shown in FIG. 22B by a solid line. This corrects the non-uniformity of the machined amounts per unit circumferential length at the pre-machined surface of each cam-lobe portion 61, and restricts the increase of surface roughness of the pre-machined surface, particularly of the event regions "b1, b2".

Further, the control for varying the work rotational speed Vw is as follows. As shown in FIG. 23A, the controller 100 controls the operation of the rotational driving unit 40 such as including the main-shaft-aimed motor M1, such that the work rotational speed Vw upon machining the event regions "b1, b2" of the applicable cam-lobe portion 61 becomes slower than work rotational speeds Vw upon machining the other regions.

Concretely, the controller 100 outputs a controlling signal to the main-shaft-aimed motor M1 so as to control the rotational speed of this main-shaft-aimed motor M1, such that the work rotational speed Vw becomes a normal speed when the applicable rotating cam-lobe portion 61 has reached its initial position, that the work rotational speed Vw becomes a reduced speed slower than the normal speed while the cam-lobe portion 61 has rotated and contacts with the event regions "b1, b2", and that the work rotational speed Vw becomes the normal speed when the cam-lobe portion 61 has further rotated and reached its reverse position.

If the work rotational speed Vw is kept constant during lapping, the circumferential speed of the event region "b1"/"b2" becomes higher than the circumferential speed of the base region "d", so that the contact time of the event region "b1"/"b2" with the film 11 becomes shorter than the contact time of the base region "d" with the film 11. Contrary, controlling the work rotational speed Vw in the above manner reduces the circumferential speed of the event region "b1"/"b2" upon machining the same, thereby prolonging the contact time of the event region "b1"/"b2" with the film 11. This corrects the non-uniformity of the machined amounts per unit circumferential length at the pre-machined surface of each cam-lobe portion 61, and restricts the increase of surface roughness of the pre-machined surface, particularly of the event regions "b1, b2".

Note, the contact time of the top region "a" with the film 11 is not actively prolonged in the illustrated controlling configuration. This is because, the contact surface pressure of the top region "a" is inherently high (see FIG. 22B) so that the surface roughness of the top region "a" satisfies the demanded level. Only, it is possible to control the rotational speed of the main-shaft-aimed motor M1 such that the work rotational speed Vw upon machining the applicable top region "a" becomes slower than that upon machining the associated base region "d", so as to further lower the surface roughness of the top region "a".

Moreover, the control for varying the oscillation speed Vo is as follows. As shown in FIG. 23B, the controller 100 controls the operation of the oscillation unit 50 such as including the motor, such that the oscillation speed Vo upon machining the event region "b1"/"b2" of the applicable cam-lobe portion 61 becomes faster than that upon machining the other regions.

Concretely, the controller 100 outputs a controlling signal to the oscillation motor M2 so as to control the rotational speed of this oscillation motor M2, such that the oscillation speed Vo becomes a normal speed (such as 10 Hz) when the rotating cam-lobe portion 61 has reached its initial position, that the oscillation speed Vo becomes an increased speed faster than the normal speed while the cam-lobe portion 61 has rotated and contacts with the event regions "b1, b2", and that the oscillation speed Vo becomes the normal speed when the cam-lobe portion 61 has further rotated and reached its reverse position.

If the oscillation speed Vo is kept constant during lapping, there is attained a fixed distance along which one piece of abrasive grain of the film 11 acts on the pre-machined surface per unit time. Contrary, controlling the oscillation speed Vo in the above manner prolongs the distance along which one piece of abrasive grain acts on the pre-machined surface at the event regions "b1, b2", thereby increasing the number of abrasive grains effectively acting on the pre-machined surface per unit time, in order to increase the removed amount of the pre-machined surface per unit time. This corrects the non-uniformity of the machined amounts per unit circumferential length at the pre-machined surface of each cam-lobe portion 61, and restricts the increase of surface roughness of the pre-machined surface, particularly of the event regions "b1, b2".

Note, the varying ratios of the shoe pressing forces P, work rotational speed Vw and oscillation speed Vo upon variably controlling them are not uniquely determined and are finally determined in a trial-and-error manner, because these varying ratios will vary such as depending on the work shape, the basic machining conditions (basic values of shoe pressing force, work rotational speed, and oscillation speed) and the required surface roughness.

There will be explained hereinafter an operation of this embodiment, taking a situation for variably controlling the shoe pressing force P, for example.

Firstly, the camshaft 60 is supported between the headstock 42 and tailstock 46, and the upper and lower arms 22, 23 are moved to positions of the cam-lobe portions 61, respectively. At this time, the fluid pressure cylinders 25 have contracted the associated piston rods 26 in order to hold the associated upper arms 22 and lower arms 23 at the opened positions, respectively. Thereafter, the fluid pressure cylinders 25 are operated to expand the associated piston rods 26, thereby pivoting the upper and lower arms 22, 23 in the closing directions, respectively. These closing pivotal movements cause the lapping films 11 to be set on the pre-machined surfaces of the cam-lobe portions 61, respectively.

While the upper and lower arms 22, 23 are pivoted and closed, the motors M3 are operated to rotate the wind-up reels 16, respectively. The lapping films 11 are fed by predetermined amounts so that unused abrasive-grained surfaces are set onto the pre-machined surfaces, respectively. Thereafter, the wind-up reels 16 are rotated after locking the feeding reels 15 by the locking devices near them, so that the lapping films 11 are applied with predetermined tensions. Next, the wind-up reels 16 are locked by the locking devices near them, thereby bringing the lapping films 11 into states applied with tensions without any slack.

In the state where each cam-lobe portion 61 is clamped, the eccentric rotor 35 of the applicable shoe pressing unit 330 is at the initial position thereof (eccentric angle θe=0°) and both of the associated shoes 21 are pressed by the reactive elastic forces of the work clamping springs 33, respectively. Both shoes 21 are thus pressed to the cam-lobe portion 61 by virtue of these reactive elastic forces, thereby pressing the abrasive-grained surface of the lapping film 11 to the pre-machined surface.

Moreover, the camshaft 60 is rotated around its axis by operating the rotational driving unit 40 while applying oscillation to the camshaft 60 along the axial direction thereof by operating the oscillation unit 50, so that the shoe cases 28 holding the shoes 21 advances and retracts within the concaves 27 in a manner to follow the rotation of the applicable cam-lobe portions 61, respectively, thereby lapping the pre-machined surfaces of the cam-lobe portions 61.

During this machining, the rotary encoder S1 detects the rotational positions of the cam-lobe portions 61, and the controller 100 variably controls the shoe pressing forces P correspondingly to the rotational positions of the cam-lobe portions 61 during machining, respectively. Namely, the operations of the applicable pressing motors M4 are controlled such that the eccentric angles θe of the eccentric rotors 35 become 180° while the associated shoes 21 contact the associated event regions "b1, b2", thereby increasing the shoe pressing forces P upon machining the event regions "b1, b2" as compared with the shoe pressing forces P upon machining the other regions, respectively.

This increases the contact surface pressure at the event regions "b1, b2" (FIG. 22B), thereby resultingly uniformalizing the machined amounts per unit circumferential length at the pre-machined surface of each cam-lobe portion 61, in order to restrict an increase of the surface roughness of the event regions "b1, b2" so that the surface roughness as one of machining qualities is equalized.

While the camshaft 60 has many cam-lobe portions 61, the lapping is simultaneously conducted for these cam-lobe portions 61. Upon completing the lapping, the fluid pressure cylinders 25 are operated to contract the associated piston rods 26 in order to pivot the upper and lower arms 22, 23 in the opening directions, respectively, into states where the camshaft 60 can be taken out of them. After taking out the camshaft 60, another camshaft 60 is set, thereby enabling to start the same lapping.

In case of variably controlling the work rotational speed Vw instead of controlling the shoe pressing force P, the operation is as follows.

During lapping, the rotary encoder S1 detects the rotational positions of the cam-lobe portions 61 and the controller 100 variably controls the work rotational speed Vw correspondingly to the rotational positions of the cam-lobe portions 61 during machining, respectively. Namely, the operation of the main-shaft-aimed motor M1 is so controlled that the work rotational speed Vw becomes a lower speed while the shoes 21 contact with the associated event regions "b1, b2", thereby reducing the work rotational speed Vw upon machining the event regions "b1, b2" as compared with the work rotational speed Vw upon machining the other regions (FIG. 23A).

This prolongs the contact time of the event regions "b1, b2" with the film 11, thereby resultingly uniformalizing the machined amounts per unit circumferential length at the pre-machined surface of each cam-lobe portion 61, in order to restrict an increase of the surface roughness of the event regions "b1, b2" so that the surface roughness is equalized.

In case of variably controlling the oscillation speed Vo instead of controlling the shoe pressing force P or work rotational speed Vw, the operation is as follows.

During lapping, the rotary encoder S1 detects the rotational positions of the cam-lobe portions 61 and the controller 100 variably controls the oscillation speed Vo correspondingly to the rotational positions of the cam-lobe portions 61 during machining, respectively. Namely, the operation of the oscillation motor M2 is so controlled that the oscillation speed Vo becomes a higher speed while the shoes 21 contact with the associated event regions "b1, b2", thereby increasing the oscillation speed Vo upon machining the event regions "b1, b2" as compared with the oscillation speed Vo upon machining the other regions (FIG. 23B).

This increases the number of abrasive grains effectively acting on the event regions "b1, b2", thereby resultingly uniformalizing the machined amounts per unit circumferential length at the pre-machined surface of each cam-lobe portion 61, in order to restrict an increase of the surface roughness of the event regions "b1, b2" so that the surface roughness is equalized.

As described above, the lapping apparatus 3 according to this embodiment includes: the lapping films 11; the shoes 21; the shoe pressing units 330 for pressing the shoes 21 toward the work W, thereby pressing the abrasive-grained surfaces of the lapping films 11 toward the work W, respectively; the rotational driving unit 40 for rotationally driving the work W; the oscillation unit 50 for applying oscillation to the work W along the axial direction thereof; the rotary encoder S1 for detecting the rotational position of the work W; and the controller 100 for variably controlling at least one of the shoe pressing forces P, work rotational speed Vw and oscillation speed Vo, correspondingly to the rotational position of the work W during machining; and the machined amounts per unit circumferential length at the pre-machined surface of the work W are uniformalized. Thereby the lapping apparatus 3 exhibits such an effect that even a work W having a pre-machined surface in a cross-sectionally non-circular arcuate shape can be equalized in terms of the surface roughness of the pre-machined surface. Further, the fact that the machined amounts per unit circumferential length at a pre-machined surface of a work W can be uniformalized does mean that no additional machining time is required to merely improve a machining quality such as a surface roughness at a specific site of the pre-machined surface. This enables to shorten the total machining time, not only in such a situation for increasing the shoe pressing forces P or oscillation speed Vo correspondingly to the rotational position of the work W, but also in a situation for controlling the work rotational speed Vw to slow down the same correspondingly to the rotational position of the work W.

Further, since the pre-machined surface of the work W is the outer peripheral surface of each cam-lobe portion 61 of the camshaft 60, there can be also exhibited such an effect that the machined amounts per unit circumferential length at the pre-machined surface of the cam-lobe portion 61 can be uniformalized to equalize the surface roughness of the pre-machined surface of the cam-lobe portion 61, thereby enabling to shorten the machining time of the cam-lobe portion 61.

Moreover, the shoe pressing units 330 include the adjusting units 331 for adjusting the shoe pressing forces P, respectively, and the controller 100 controls the operation of the adjusting units 331 such that the shoe pressing forces P upon machining the event regions "b1, b2" of the cam-lobe portions 61 become larger than shoe pressing forces P upon machining the other regions in order to increase the contact surface pressures at the event regions "b1, b2". Thus, there can be resultingly obtained such an effect that the increase of surface roughness of the event regions "b1, b2" is restricted and the surface roughness of the pre-machined surfaces of the cam-lobe portions 61 is equalized.

Furthermore, the controller 100 controls the operation of the rotational driving unit 40 such that the work rotational speed Vw upon machining the event regions "b1, b2" of the cam-lobe portions 61 become slower than the work rotational speed Vw upon machining the other regions in order to prolong the contact times at the event regions "b1, b2" with the lapping film 11. Thus, there can be resultingly obtained such an effect that the increase of surface roughness of the event regions "b1, b2" is restricted and the surface roughness of the pre-machined surfaces of the cam-lobe portions 61 is equalized.

In addition, the controller 100 controls the operation of the oscillation unit 50 such that the oscillation speed Vo upon machining the event regions "b1, b2" of the cam-lobe portions 61 become faster than the oscillation speed Vo upon machining the other regions in order to increase the number of abrasive grains effectively acting on the event regions "b1, b2". Thus, there can be resultingly obtained such an effect that the increase of surface roughness of the event regions "b1, b2" is restricted and the surface roughness of the pre-machined surfaces of the cam-lobe portions 61 is equalized.

Meantime, since the shoes 21 comprise concave shoes 21 held in a neck-swingable member and having concave tip end portions for abutting on the pre-machined surfaces of the work W at multiple locations via lapping films 11, there can be exhibited such an effect that the work W is stably rotated and stably lapped in order to improve the machining quality.

Further, the inextensible and deformable lapping films 11 enable to preferably lap the work W having the pre-machined surfaces in cross-sectionally non-circular arcuate shapes.

Moreover, the lapping apparatus 3 of this embodiment is to detect the rotational position of the work W by the rotary encoder S1 and to variably control at least one of the shoe pressing forces P, work rotational speed Vw and oscillation speed Vo correspondingly to the rotational position of the work W during machining in order to embody the lapping method for uniformalizing the machined amounts per unit circumferential length at the pre-machined surfaces of the work W. Thus, there can be exhibited such an effect that the surface roughness of the pre-machined surfaces is equalized even in the work W having the pre-machined surfaces in cross-sectionally non-circular arcuate shapes while enabling to shorten the total machining time.

Modified Embodiment

Although there has been described the embodiment for variably controlling at least one of the shoe pressing forces P, work rotational speed Vw and oscillation speed Vo correspondingly to the rotational position of the work W during machining, the present invention is not limited thereto. For example, it is possible to adopt such a configuration for combining variable controls of: shoe pressing forces P and work rotational speed Vw; shoe pressing forces P and oscillation speed Vo; work rotational speed Vw and oscillation speed Vo; or all of shoe pressing forces P, work rotational speed Vw and oscillation speed Vo.

Further, the pre-machined surface of the work W is not delimited to the cam-lobe portion 61 of the camshaft 60, and other various works W are of course applicable insofar as having pre-machined surfaces in cross-sectionally non-circular arcuate shapes.

Although this embodiment has been exemplified in the configuration using the work clamping springs 33, eccentric rotors 35, pressing motors M4 and the like as the shoe pressing units 330 and the adjusting units 331 included therein, this embodiment can be appropriately modified without limited thereto. For example, it is possible to pressing the shoes 21 to the work W in order to press the abrasive-grained surfaces of the lapping film 11 toward the work W, by utilizing a fluid pressure cylinder such as operated by air pressure. In this case, the shoe pressing force P may be adjusted such as by adjusting the air pressure to be supplied to the fluid pressure cylinder or by turning on/off the air pressure by an electromagnetic valve.

Further, although the rotational driving unit 40 in the illustrated embodiment variably controls the work rotational speed Vw by varying the rotational speed of the main-shaft-aimed motor M1, it is possible to variably control the work rotational speed Vw by changing a gear ratio of a transmission arranged between an output shaft and a main shaft of the main-shaft-aimed motor M1.

Moreover, although the work W is applied with oscillation by applying oscillation to the table 49 in case of the oscillation unit 50 of the illustrated embodiment, it is possible to apply oscillation to the main shaft 41 supporting the work W. Further, it is not indispensable to apply oscillation to the work W, and it is possible to apply oscillation to the lapping film 11, or to both of the work W and lapping film 11.

Lastly, although the concave shoes 21 have been exemplarily described as shoes, the present invention is also applicable to a situation for using convex shoes having tip end portions in convex arc shapes.

The entire content of a Japanese Patent Applications No. P2003-34050 and No. P2003-34065 with a filing date of Feb. 12, 2003 is herein incorporated by reference.

Although the invention has been described above by reference to certain embodiments of the invention, the invention is not limited to the embodiments described above will occur to these skilled in the art, in light of the teachings. The scope of the invention is defined with reference to the following claims.

What is claimed is:

1. A lapping apparatus for lapping a work having a pre-machined surface, comprising:

a lapping film which includes a thin substrate having a surface provided with abrasive grains;

a shoe disposed at a back surface side of the lapping film;

a shoe driving unit which drives the shoe toward the work in order to press the abrasive-grained surface of the lapping film to the pre-machined surface of the work;

a rotational driving unit which drives the work rotationally;

a detecting unit which detects a rotational position of the work in a rotating direction thereof; and a controlling unit which controls the pressing force of the shoe driving unit so as to drive the shoe correspondingly to the position of the work in the rotating direction during machining.

2. The lapping apparatus of claim 1, wherein the pre-machined surface of the work is formed with an open holed portion, the shoe comprises: a first shoe which presses the abrasive-grained surface of the lapping film to the pre-machined surface; and a second shoe which presses the abrasive-grained surface of the lapping film to a mouth base of the holed portion, the shoe driving unit drives the second shoe between an operative position where the second shoe is pressed to the mouth base of the holed portion and an inoperative position where the second shoe is separated away from the mouth base of the holed portion, the detecting unit detects the position of the holed portion of the rotating work, the controlling unit controls an operation of the shoe driving unit so as to drive the second shoe toward the operative position or the inoperative position correspondingly to the position of the holed portion during machining, and the lapping to be conducted by pressing the lapping film to the rotating work by the second shoe is delimited to the vicinity of the mouth base of the holed portion.

3. The lapping apparatus of claim 2, wherein the first shoe comprises a hard shoe and the second shoe comprises a soft shoe.

4. The lapping apparatus of claim 2, wherein the holed portion is a lubricant hole.

5. The lapping apparatus of claim 2, wherein the lapping film is inextensible and deformable.

6. The lapping apparatus of claim 1, wherein the pre-machined surface of the work is formed with an open holed portion, and the shoe includes a first shoe member constituting a hard shoe and a second shoe member constituting a soft shoe, the second shoe member being arranged at a location pressing the lapping film to a mouth base of the holed portion.

7. The lapping apparatus of claim 6, wherein the lapping film is inextensible and deformable.

8. The lapping apparatus of claim 1, wherein the pre-machined surface of the work is in a cross-sectionally non-circular arcuate shape, the lapping apparatus further comprises an oscillation unit which applies oscillation along an axial direction of the work, to at least one of the work and the lapping film, and the controlling unit variably controls at least one of a shoe pressing force, a work rotational speed and an oscillation speed, correspondingly to the position of the work in the rotating direction during machining, in order to uniformalize the machined amounts per unit circumferential length at the pre-machined surface of the work.

9. The lapping apparatus of claim 8, wherein the pre-machined surface of the work is an outer peripheral surface of a cam-lobe portion of a camshaft.

10. The lapping apparatus of claim 9, wherein the shoe driving unit includes an adjusting unit which adjusts the shoe pressing force, and the controlling unit controls an operation of the adjusting unit so that the shoe pressing force upon machining an event region of the cam-lobe portion becomes larger than the shoe pressing force upon machining the other regions of the cam-lobe portion.

11. The lapping apparatus of claim 9, wherein the controlling unit controls an operation of the rotational driving unit so that the work rotational speed upon machining an event region of the cam-lobe portion becomes slower than the work rotational speed upon machining the other regions of the cam-lobe portion.

12. The lapping apparatus of claim 9, wherein the controlling unit controls an operation of the oscillation unit so that the oscillation speed upon machining an event region of the cam-lobe portion becomes faster than the oscillation speed upon machining the other regions of the cam-lobe portion.

13. The lapping apparatus of claim 8, wherein the shoe comprises a concave shoe being held in a neck-swingable member and having a concave tip end portion which abuts on the pre-machined surface of the work at multiple locations via lapping film.

14. The lapping apparatus of claim 8, wherein the lapping film is inextensible and deformable.

15. The lapping apparatus of claim 1, wherein the work is rotated around the longitudinal axis of the work.

16. A lapping method for lapping a work having a pre-machined surface while rotationally driving the work in a state where an abrasive-grained surface of a lapping film is pressed to the pre-machined surface by a shoe, comprising:

detecting a rotational position of the work in a rotating direction thereof; and controlling the pressing force of the shoe correspondingly to the position of the work in the rotating direction during machining.

17. The lapping method of claim 16, wherein the pre-machined surface of the work is formed with an open holed portion, the shoe comprises a first shoe pressing the abrasive-grained surface of the lapping film to the pre-machined surface and a second shoe pressing the abrasive-grained surface of the lapping film to a mouth base of the holed portion, the rotational position detecting comprises detecting the position of the holed portion of the rotating work, and the pressing force controlling comprises driving the second shoe between an operative position where the second shoe is pressed to the mouth base of the holed portion and an inoperative position where the second shoe is separated away from the mouth base of the holed portion correspondingly to the position of the holed portion during machining, so that the lapping to be conducted by pressing the lapping film to the rotating work by the second shoe is delimited to the vicinity of the mouth base of the holed portion.

18. The lapping method of claim 16, wherein the pre-machined surface of the work is in a cross-sectionally non-circular arcuate shape, and the lapping method further comprises:

applying oscillation along an axial direction of the work, to at least one of the work and the lapping film, and variably controlling at least one of a shoe pressing force, a work rotational speed and an oscillation speed, correspondingly to the position of the work in the rotating direction during machining, in order to uniformalize the machined amounts per unit circumferential length at the pre-machined surface of the work.

19. The lapping method of claim 16, wherein the work is rotated around the longitudinal axis of the work.

20. A lapping apparatus for lapping a work having a pre-machined surface, comprising:

a lapping film which includes a thin substrate having a surface provided with abrasive grains;

a shoe disposed at a back surface side of the lapping film;

shoe driving means for driving the shoe toward the work in order to press the abrasive-grained surface of the lapping film to the pre-machined surface of the work;

rotational driving means for driving the work rotationally;

detecting means for detecting a rotational position of the work in a rotating direction thereof; and controlling means for controlling the pressing force of the shoe driving means so as to drive the shoe correspondingly to the position of the work in the rotating direction during machining.

21. The lapping apparatus of claim 20, wherein the pre-machined surface of the work is formed with an open holed portion, the shoe comprises: a first shoe which presses the abrasive-grained surface of the lapping film to the pre-machined surface; and a second shoe which presses the abrasive-grained surface of the lapping film to a mouth base of the holed portion, the shoe driving means drives the second shoe between an operative position where the second shoe is pressed to the mouth base of the holed portion and an inoperative position where the second shoe is separated away from the mouth base of the holed portion, the detecting means detects the position of the holed portion of the rotating work, the controlling means controls an operation of the shoe driving means so as to drive the second shoe toward the operative position or the inoperative position correspondingly to the position of the holed portion during machining, and the lapping to be conducted by pressing the lapping film to the rotating work by the second shoe is delimited to the vicinity of the mouth base of the holed portion.

22. The lapping apparatus of claim 20, wherein the pre-machined surface of the work is formed with an open holed portion, and the shoe includes a first shoe member constituting a hard shoe and a second shoe member constituting a soft shoe, the second shoe member being arranged at a location pressing the lapping film to a mouth base of the holed portion.

23. The lapping apparatus of claim 20, wherein the pre-machined surface of the work is in a cross-sectionally non-circular arcuate shape, the lapping apparatus further comprises oscillation means for applying oscillation along an axial direction of the work, to at least one of the work and the lapping film, and the controlling means variably controls at least one of a shoe pressing force, a work rotational speed and an oscillation speed, correspondingly to the position of the work in the rotating direction during machining, in order to uniformalize the machined amounts per unit circumferential length at the pre-machined surface of the work.

24. The lapping apparatus of claim 20, wherein the work is rotated around the longitudinal axis of the work.

* * * * *